US007312009B2

(12) United States Patent
Lee et al.

(10) Patent No.: US 7,312,009 B2
(45) Date of Patent: Dec. 25, 2007

(54) COLOR TONER HAVING LOW CONTAMINATION OF CHARGING ELEMENTS

(75) Inventors: Hyeung-Jin Lee, Busan (KR); Joo-Yong Park, Daejeon (KR); Chang-Soon Lee, Daejeon (KR)

(73) Assignee: LG Chem, Ltd, Seoul (KR)

( * ) Notice: Subject to any disclaimer, the term of this patent is extended or adjusted under 35 U.S.C. 154(b) by 408 days.

(21) Appl. No.: 10/535,222

(22) PCT Filed: May 13, 2005

(86) PCT No.: PCT/KR2005/001409

§ 371 (c)(1),
(2), (4) Date: May 17, 2005

(87) PCT Pub. No.: WO2005/111721

PCT Pub. Date: Nov. 24, 2005

(65) Prior Publication Data

US 2006/0127787 A1 Jun. 15, 2006

(30) Foreign Application Priority Data

May 13, 2004 (KR) ..... 10-2004-0033784

(51) Int. Cl.
*G03G 9/093* (2006.01)

(52) U.S. Cl. ..... 430/108.3; 430/108.6; 430/108.7; 430/110.1; 430/110.4; 430/137.21

(58) Field of Classification Search ..... 430/108.3, 430/108.6, 108.7, 110.1, 110.4, 37.21
See application file for complete search history.

(56) References Cited

U.S. PATENT DOCUMENTS

| | | | | |
|---|---|---|---|---|
| 4,837,101 | A | 6/1989 | Gruber et al. | |
| 4,948,686 | A | 8/1990 | Koch | |
| 5,275,905 | A | 1/1994 | Ciccarelli et al. | |
| 2005/0238986 | A1* | 10/2005 | Itoh | 430/110.2 |

FOREIGN PATENT DOCUMENTS

| | | |
|---|---|---|
| KR | 1996-0024716 | 7/1996 |
| KR | 2003-0056152 | 7/2003 |
| WO | WO 03/087951 A1 | 10/2003 |

OTHER PUBLICATIONS

Korean Intellectual Property Office; "*Toner for Electrophotography*"; Publication No. 100349775 (Aug. 9, 2002).

* cited by examiner

*Primary Examiner*—Hoa Van Le
(74) *Attorney, Agent, or Firm*—McKenna Long & Aldridge LLP

(57) ABSTRACT

The present invention relates to a non-magnetic mono-component toner comprising a toner mother particle, and a coating layer formed on the mother particle where the coating layer comprises fatty acid metal salt having average particle size of 0.05 to 3.0 μm, a first organic particle having average particle size of 0.3 to 2.0 μm, a second organic particle having average particle size of 0.05 to 0.25 μm, and silica having average particle size of 0.006 to 0.04 μm. The color toner has narrow charge distribution, high chargeability, a low environmental dependence, and excellent image quality, transfer efficiency, and long-term stability by significantly reducing the contamination of the charging elements.

22 Claims, 1 Drawing Sheet

COLOR TONER HAVING LOW CONTAMINATION OF CHARGING ELEMENTS

This application claims priority to PCT/KR2005/001409, filed on May 13, 2005, Korean Patent Application No. 10-2004-0033784 filed May 13, 2004, the contents of which are incorporated herein by reference in their entirety.

BACKGROUND OF THE INVENTION

1. Field of the Invention

The present invention relates to a non-magnetic mono-component color toner, and more specifically to a non-magnetic mono-component color toner having a narrow charge distribution, good chargeability, good environmental independence, superior image characteristics, high transfer efficiency, and excellent long-term stability and image quality.

2. Description of the Related Art

The recent hard-copying and printing techniques using image formation methods such as electrophotographs, are rapidly moving toward full color from black and white. In particular, the color printer market is expanding very rapidly. In general, formation of color images by full color electrophotography is carried out with three colors comprising cyan, magenta, and yellow, or four colors further comprising black, to reproduce all colors. In this rapidly growing full color market, high image quality, good reliability, compactness, light-weight, low price, high speed, and furthermore environmental aspects such as low energy consumption, recyclability and so forth are strongly required. Improvement and development of image formation methods and toners to satisfy these requirements are widely in progress.

In general, image formation in electrophotography includes the steps of uniformly charging a drum surface, exposing the drum surface and forming an electrostatic latent image, developing the latent image on the drum surface using a toner formed on the surface of a developing roller and obtaining a toner image, transferring the toner image, fixing the toner image, and, a cleaning step that removes the toner remaining on the drum surface from the transfer step.

Each step of the image formation process in electrophotography requires the following basic characteristics from a toner. The developing step requires an appropriate charging of the toner, charge maintenance, and environmental independence. The transfer step requires good transfer characteristics. The settlement step requires the characteristics of low-temperature fixing and offset resistance. And lastly, the cleaning step requires good cleaning performance and contamination resistance. Recently, the above characteristics have become more important with the trend toward high resolution, high speed, and full color.

With regard to long-term maintenance of image quality for repeated printing, there is a method of mixing four colors directly in a photoconductive drum in the transfer step. And recently, indirect transfer image formation has been mainly used in full color printers because it can offer high speed and good image quality. In indirect transfer image formation, a toner image of each color on the drum surface is repeatedly transferred to an intermediate transfer belt, and then the image as a whole is transferred onto paper.

However, because indirect transfer image formation requires more toner transfer steps, charging elements can be more easily contaminated, thereby making it difficult to obtaining accurate transfer performance.

In order to obtain stable long-term and high-quality full color images, research on additives, toner shape, surface structure control, and so forth are required to obtain higher charging stability and to minimize the contamination in charging elements.

With regard to the cleaning step, reduction of remaining toner after transfer and reducing the cleaner size are important tasks for improving environmental independence.

To overcome these problems of the transfer and cleaning steps, it is important to maintain uniform electrification. One of the characteristics required for this purpose is to prevent the deterioration of electrification which is caused by contamination in charging elements. For this purpose, it is best not to use material which contaminates the charging elements, but when such material is essential, an additive can be used that makes cleaning easier by decreasing the adhesive force of the charging elements. Although the former situation is ideal, in actual toner manufacturing processes, it is not always possible to use materials with desired characteristics, so the latter is mostly the case. In addition, it is important to reduce the remaining toner amount, and thus to improve and maintain transfer efficiency of the toner.

Fine particles such as silica may be added to the toner to reduce its adhesiveness to the photoconductive drum. However, in case of using fine silica particles, it is intervened between toner and drum to reduce the toner's adhesiveness to the drum and improve its transfer efficiency, so in order to obtain good transfer efficiency, the level of cover of the toner surface by the particles has to be high. Consequently, the amount of added fine particles increases and the toner charging characteristics become poor. Moreover, the fine particles may adhere to electrostatic latent image carriers, and filming or fixing problems may occur. In particular, silica particles may cause problems of image density irregularity at low temperature and humidity, and non-image area contamination at high temperature and humidity, because they are highly environment-dependent.

Korean Patent Publication No. 1996-0024716 discloses a toner for electrophotography comprising a fine powder fatty acid metal salt the surface of which is treated with hydrophobic silica, or fine powder of a melted mixture of fatty acid metal salt the surface of which is treated with hydrophobic silica, and resin. In addition, Korean Patent Publication No. 2003-0056152 discloses the mono-component magnetic toner composition comprising a mother particle of magnetic toner, hydrophobic silica having specific surface area of 20-80 $m^2/g$, hydrophobic silica having specific surface area of 130-230 $m^2/g$, and metal oxide fine powder. However, the documents do not disclose the spherical organic fine powder which is an essential component of the present invention.

As a method for improving environmental independence of a toner, addition of inorganic fine particles having electric resistance lower than that of silica particles and good electrification, such as titanium oxide particles, is known. However, if inorganic fine particles having lower electric resistance are used, charge distribution of the toner may change easily. Also, it may result in poor second transfer when using an intermediate transfer belt or retransfer of wrong sign color toner during multiple transfers.

A method of increasing resistance of inorganic fine particles by treating the surface with a silane coupling agent, etc. was proposed to solve this problem. However, cohesion of the fine particles becomes so severe that their dispersibility on the toner surface decreases. Also, fluidity of the toner may decrease or blocking may occur due to free cohered particles.

Accordingly, research on a color toner having a narrow charge distribution, good charging characteristics, environmental independence, and long-term stability without contamination of the charging elements, is in much demand.

SUMMARY OF THE INVENTION

An object of the present invention is to provide a non-magnetic mono-component color toner composition having superior image characteristics, transfer efficiency, long-term stability, and long-term reliability by reducing the contamination of the charging elements, and a preparation method thereof.

The inventors of the present invention worked on a method of preparing color toner for use in electrophotography having narrow charge distribution, high chargeability, long-term stability, and long-term maintenance of good image quality by reducing contamination of the charging elements. In doing so, they realized that toner mother particle coated with fatty acid metal salt, two kinds of organic particles with different particle size, and silica have a narrow charge distribution, high chargeability, and image quality, transfer efficiency and long-term stability by reducing contamination of the charging elements, and long-term reliability due to a significant improvement in charge maintenance capability.

The present invention provides a non-magnetic mono-component color toner comprising a toner mother particle and a coating layer thereon, where the coating layer contains a fatty acid metal salt having an average particle size of 0.05 to 3.0 μm, a first organic particle having an average particle size of 0.3 to 2.0 μm, a second organic particle having an average particle size of 0.05 to 0.25 μm, and silica having an average particle size of 0.006 to 0.04 μm.

The non-magnetic mono-component color toner particle is spherical and has an average particle size of 20 μm or less, and an aspect ratio of short radius against long radius of 0.3 to 0.8.

DETAILED DESCRIPTION OF THE ILLUSTRATED EMBODIMENTS

Figure 1:
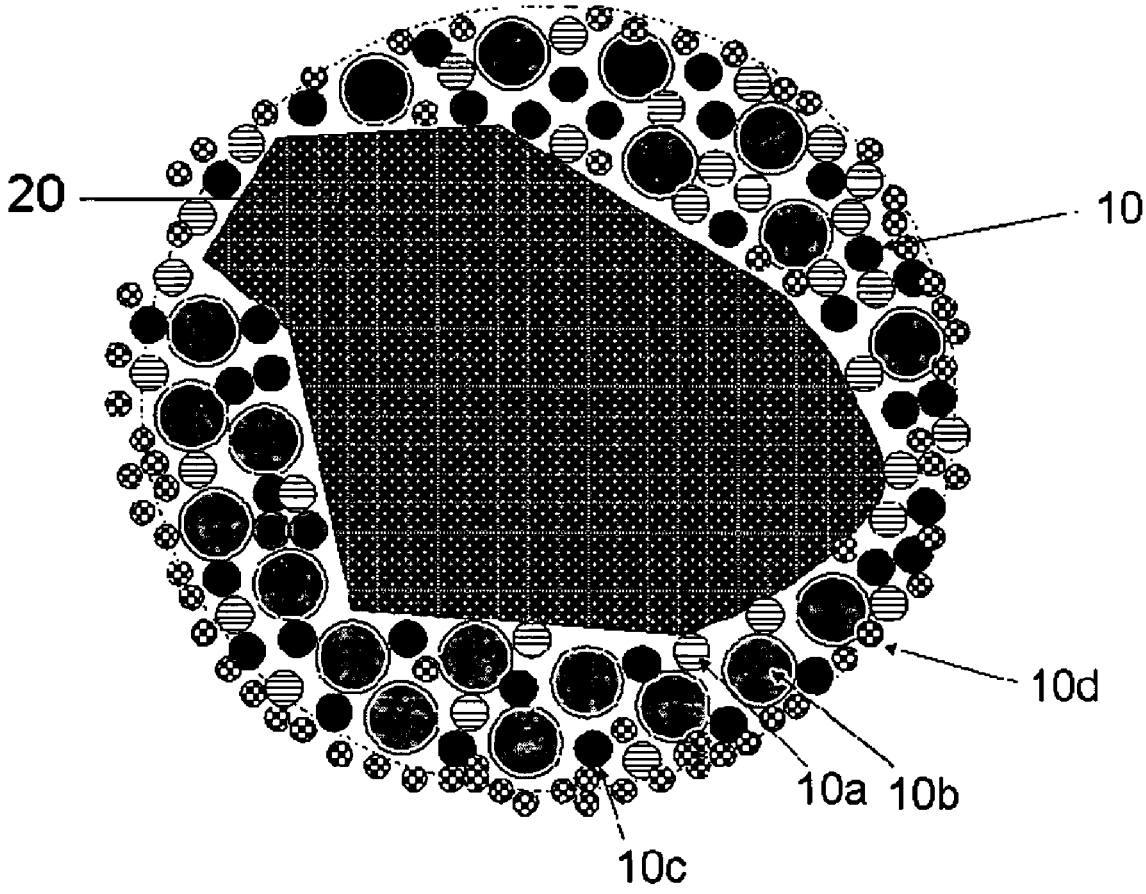
FIG. 1 is a sectional view showing the structure of the non-magnetic mono-component color toner of the present invention.

The charging behavior of toner is affected by the composition of the coating layer formed on the surface of the toner particle. The toner particle of the present invention acts as a spherical toner, by including fatty acid metal salt, two kinds of organic particles with different particle size, and silica in the coating layer formed on the surface of toner mother particle. The toner particle of the present invention has reduced friction resistance between sleeve and charging blade during toner charging, and thus prevents toner melting on charging blade and formation of solid adhesion between toners. In addition, in the present invention, an improvement in the ability to clean remaining toner upon transfer to surface of organic photo drum, and released additives prevents contamination of the primary charge roller (PCR), so as to produce a stable image in the long run.

In particular, the use of the fatty acid metal salt in combination with two kinds of organic particles with different particle size on the surface of toner mother particle decreases the friction resistance of toner in contact with the surface of the charging blade, and maximizes the ability to clean the organic photo drum.

FIG. 1 is a sectional view showing the structure of the color toner according to the present invention. The color toner has a core-shell type structure containing a toner mother particle 20, and a coating layer 30 formed on surface of the toner mother particle.

As shown in FIG. 1, the toner mother particle 20 is typically an irregularly-shaped particle. Compared to the conventional dual-component developing method and magnetic developing method, the non-magnetic mono-component developing method of the present invention does not have any magnetic force that attracts toner particles onto the surface of the sleeve, and thus the toner surface must be strongly charged in order to prevent scatter of toner particles during the developing step. Excessive charging for this reason causes friction between charging blade and toner particle, and leads to melting of the toner surface and cohesion of the toner particles which then cease to function as toner particles. In addition, the shape of conventional toner is not spherical but irregular. When irregularly-shaped toner is used, the protruding part of the mother particle is excessively charged, while the sunken-in part is insufficiently charged, thereby producing unequal charge distribution on the toner particle.

The coating of fatty acid metal salt 10*a*, two kinds of organic particle with different particle size 10*b*, 10*c*, and silica 10*d* on toner mother particle 20 fills the sunken-in part of toner mother particle 20, and thus the toner of the present invention can display a spherical toner-like behavior.

The fatty acid metal salt 10*a* of coating layer 10 is on the surface of toner mother particle 20, to endow a lubricating property to the toner particle. Thus, the fatty acid metal salt 10*a* prevents filming where the toner adheres to the surface of organic photo drum, chipping of the cleaning blade, and abrasion of the toner particle. In particular, the fatty acid metal salt 10*a* is good for preventing excessive adhesion of the toner on the organic photo drum because it has various particle sizes, and good coating property on the toner surface compared to other materials which endow a lubricating property to the toner particle. However, if the fatty acid metal oxide 10*a* is excessively used, reduction in coating properties of other additives such as silica accelerates the release of the additives. The release of the additives deteriorates the chargeability and tends to increase the adhesion of the toner to the organic photo drum. Therefore, the particle size and the amount of fatty acid metal salt 10*a* in the coating layer needs to be adjusted.

The average particle size of the fatty acid metal salt is preferably 0.05 to 3.0 μm, more preferably 0.5 to 1.5 μm. If the particle size of the fatty acid metal salt is less than 0.05 μm, the excessively fine particles increase the lubricating property of toner, but is liable to cause filming by diminishing the cleaning property. Also, because the excessively fine particles of fatty acid metal salt cause melt-adhesion of toner on the sleeve surface, the image quality become lower. If the particle size exceeds the range, the excessively large particle size diminishes the coating property of fatty acid metal salt, thereby becoming susceptible to release. Also, it causes an ill effect on the coating property of toner, such as other fine additives such as silica coating the surface of the fatty acid metal salt, and long-term stability and image characteristics is deteriorated.

In addition, the amount of the fatty acid metal salt is 0.1 to 0.2 parts by weight, more preferably 0.5 to 1.5 parts by weight on the basis of the toner mother particle of 100 parts by weight. If the amount is less than the limit, the effect derived from addition of the fatty acid metal salt cannot be obtained. If the amount exceeds the limit, a large quantity of the fatty acid metal salt exists on the surface of the toner particle thereby decreasing coating by other additives. The release of such other additives contaminates the charging elements more, and reduces the transfer efficiency and long-term reliability.

For the fatty acid metal salt in the present invention, metal salt of C4 to C40 natural or synthetic fatty acid with C4 to C40, preferably C12 to C18 can be used.

The fatty acid can be saturated or unsaturated, and can include hydroxyl, aldehyde, or epoxy group. Examples of the fatty acid are one or more selected from the group consisting of caproic acid, caprylic acid, capric acid, lauric acid, myristric acid, millistrike oleic acid, palmitic acid, palmitoleic acid, stearic acid, oleic acid, linoleic acid, linolenic acid, arachidic acid, arachidonic acid, beheic acid, elchaic acid, montenic acid, iso-stearic acid, and epoxy stearic acid. Examples of metal are one or more selected from the group consisting of Na, K, Al, Ca, Zn, Mg, Co, Fe, Mn, Ba, Vd and Sn.

The fatty acid metal salt of the present invention, for example when the fatty acid is stearic acid, the metal salt includes sodium strearate, potassium stearate, calcium stearate, barium stearate, magnesium stearate, zinc stearate, aluminum stearate, and etc. the content of the metal contained in the fatty acid metal salt is equal to or less than 10 wt %, preferably 2.0 wt % to 10 wt %. If the metal content is more than 10 wt %, it cannot endow a lubricating property on toner particle, but increase the conductivity, thereby lowering chargeability of the toner and its coating property of toner mother particle. If the metal content is less than 2.0 wt %, the chargeability of the toner can be improved by charge accumulation of the fatty acid metal salt, but cannot provide sufficient lubricating property, nor lower the contamination. The reason for limiting the metal content in fatty acid metal salt is that different charge accumulation caused by the metal content affects chargeability of the toner particle, and that different coating property of toner mother particle affects contamination of the charging elements.

The organic particle including the first organic particle 10*b* and the second organic particle 10*b* contained in the coating layer 10 reduces the friction resistance met by the toner between the sleeve and the charging blade, by contacting the charging blade during charging of the drum surface. Thus, the organic particle prevents the toner from solid adhesion on drum or roller.

In particular, the first organic particle 10*b* is a large organic particle having an average particle size of 0.3 to 2.0 μm, preferably 0.4 to 2.0 μm. The second organic particle 10*c* is a small organic particle having an average particle size of 0.05 to 0.25 μm, preferably 0.1 to 0.15 μm.

The first organic particle such as the first organic particle 10*b* prevents excessive charging in part by reducing friction heat generated in the charging blade and sleeve in the charging process, which improves the uniform charge distribution and long-term stability. If the average particle size of the large organic particle is more than 2.0 μm, the increased interval between the charging blade and sleeve provides insufficient charging, or another part of the toner mother particle is susceptible to adhesion due to high pressure. If the particle size is less than 0.3 μm, it is difficult to obtain objective function to reduce friction between the charging blade and sleeve.

Unlike the large organic particle, the small organic particle such as the second organic particle 10*c* contributes to improving the chargeability and uniform charge distribution of toner, rather than reduce friction heat. In other words, the small organic particle has high chargeability and large surface area, and thus contributes to chargeability more than the large organic particle. In addition, the small organic particle can reduce the load on cleaning blade in the cleaning for OPC drum. Therefore, charge maintenance and long-term reliability can be achieved by using the large organic particle in combination with the small organic particle, in order to utilize the effect of each particle size.

The amount of the first organic particle 10*b* is 0.1 to 2.0 parts by weight, preferably 0.1 to 15 parts by weight based on the toner mother particle of 100 parts by weight. The amount of the second organic particle 10*c* is 0.05 to 2.0 parts by weight, preferably 0.1 to 15 parts by weight based on the toner mother particle of 100 parts by weight.

If the amount of the first organic particle 10*b* is below the range, it is difficult to achieve uniform charge distribution from a reduction in excessive friction force. If the amount of the first organic particle exceeds the range, uniform charge distribution can be achieved, but the toner is liable to adhesion from excessive pressure due to excessive coherence in a part of the large organic particle. In addition, when the amount of the large organic particle used is excessive, the large organic particle with poor coating property is susceptible to release from the toner mother particle 10, and then contaminates the charging roller. Thus, the reduction in transfer efficiency makes it difficult to achieve charge maintenance.

In addition, if the amount of the second organic particle 10*c* is less than the range, it is difficult to achieve high chargeability from the small organic particle with high chargeability. On the other hand, if it exceeds the range, high chargeability can be obtained, but the excessive amount of small organic particle is released from the toner surface to cause the contamination of the charging element and transfer belt during the printing process, and leads to a decline in image quality and transfer efficiency.

The organic particle can be a polymer which is generally used in the art. Examples of the polymer are (a) a homopolymer or copolymer prepared by one or more monomers selected from the group consisting of styrenes such as styrene, methylstyrene, dimethylstyrene, ethyle styrene, phenyl styrene, chloro styrene, hexyl styrene, octyl styrene, and nonyl styrene; vinylhalides such as vinylchloride and vinylfluoride; vinylesteres such as vinylaceate and vinylbenzoate; methacrylates such as methylmethacrylate, ethyl methacrylate, propyl methacrylate, n-butyl methacrylate, iso-butyl methacrylate, 2-ethylhexyl methacrylate, and phenyl methacrylate; acrylic acid derivatives such as acrylonitrile and methacrylonitrile; acrylates such as methylacrylate, ethylacrylate, butylacrylate, and phenylacrylate; tetrafluoroethylene; and 1,1-difluoroethylene. Examples of polymer include (b) a polymer selected from the group consisting of the homopolymer and the copolymer, blended with a resin selected from the group consisting of styrene-based resin, epoxy-based resin, polyester-based resin, and polyurethane-based resin.

The silica of coating layer 10 lowers adhesion of toner to drum due to good exfoliation. The silica preferably has an average particle size of 0.006-0.04 μm (6 nm to 40 nm), preferably 0.01-0.02 μm (10 nm to 20 nm) 10-40 nm. If the particle size of the silica exceeds the range, it is susceptible to release from the toner mother particle. If the particle size of the silica is below the range, the reduction in the adhesion of toner to the drum is insufficient.

The amount of silica is determined in consideration of its particle size and the adhesion force between the toner and drum. It preferably comprises 1.0 to 4.0 parts by weight with respect to the 100 parts by weight of toner mother particle. If the amount of silica is more than 4.0 parts by weight, it is susceptible to release from the toner mother particle, and causes uneven image at low temperature and low humidity and serious contamination of non-printed region at high temperature and high humidity due to its environmental dependence. On the other hand, if the amount of silica is less than 1.0 part by weight, it is difficult to reduce the adhesion force of toner, thereby lowering the transfer efficiency.

Silica 10*d* treated for hydrophobicity because of its innate property or the effect of the moisture during long-term storage which lowers the image density, can be used hydrophobic treatment of the silica surface can be performed by silane compounds such as a surface modifying agent selected from the group consisting of dimethyldichlorosilane, dimethylpolysiloxane, hexamethyldisilazane, aminosilane, alkylsilane of C1 to C20, and octamethylcyclotetrasiloxane.

As shown in FIG. 1, in the present invention a toner particle is prepared by coating irregularly-shaped toner mother particle with fatty acid metal salt 10*a*, two kinds of the organic particle having different average particle size 10*b*, 10*c*, and silica 10*d* to provide a spherical toner particle The thickness of the coating layer is 30 nm to 2.0 μm. The fatty acid metal salt, organic particle and silica filled the sunken-in part of toner mother particle, but not uniformly coats the toner mother particle. Thus, the particle size of the color toner can be different in part from that of the toner mother particle, but the number average particle size of the toner does not affected by the unevenly distributed coating material.

The toner mother particle used in the present invention is not particularly limited, and comprises a binder resin, and a colorant as essential components.

The toner mother particle 20 can be prepared by kneading-crushing, suspension-polymerization, emulsion-polymerization, or emulsion-aggregate, etc., or can be commercially purchased. The toner mother particle can be spherical or irregular-shaped.

The binder resin may be one or a mixture of: an acrylate-based polymer such as poly(methylacrylate), poly(ethylacrylate), poly(butyacrylate), poly(2-ethylhexylacrylate), and poly(laurylacrylate); a methacrylate-based polymer such as poly(methylmethacrylate), poly(butylmethacrylate), poly(hexylmethacrylate), poly(2-ethylhexylmethacrylate), and poly(laurylmethacrylate); an acrylate methacrylate copolymer; a copolymer of styrene-based monomer and acrylates or methacrylates; an ethylene-based homopolymer or copolymer such as poly(vinylacetate), poly(vinylpropinate), poly(vinylbutyrate), polyethylene and polypropylene; a styrene-based copolymer such as styrene-butadiene copolymer, styrene-isoprene copolymer, styrene-malerate copolymer; a polystryrene base resin; a polyvinylether based resin; a polyvinylketone based resin; a polyester based resin; a polyurethane based resin; an epoxy resin; or a silicone resin.

Preferably, the polymer is at least one selected from the group consisting of polystyrene-based resin, polyester-based resin, polyethylene resin, polypropylene resin, styrene alkylacrylate copolymer of C1 to C18, stryrene alkylmethacrylate copolymer, styrene acrylonitrile copolymer, styrene butadiene copolymer, and styrene malerate copolymer.

The colorant is used for forming a visible image at a sufficient concentration. A magnetic dye or pigment exhibiting cyan, magenta, yellow or black, which are generally used in color printing can be used in the present invention. Carbon black is usually used as a black colorant.

For the cyan colorant, a nigrosine dye, aniline blue, charcoal blue, methylene blue, phthalocyanine blue, lamp black, Prussian blue, C.I. pigments blue 9, 15, 15:1, and 15:3 can be used.

For the magenta colorant, dupont oil red, rose Bengal, C.I. pigment red 48:1, C.I. pigment red 48:4, C.I. pigment red 122, C.I. pigment red 57:1, C.I. pigment red 257, and C.I. pigment red 296 can be used.

For the yellow colorant, Chrome yellow chloride, C.I. pigment yellow 97, C.I. pigment yellow 12, C.I. pigment yellow 17, C.I. pigment yellow 14, C.I. pigment yellow 13, C.I. pigment yellow 16, C.I. pigment yellow 81, C.I. pigment yellow 126, and C.I. pigment yellow 127.

The toner mother particle 20, if necessary, can further contain additives such as a fluidity accelerator, a releasing agent, a charge control agent, etc.

An inorganic oxide fine particle such as $SiO_2$, $TiO_2$, MgO, $Al_2O_3$, MnO, ZnO, $Fe_2O_3$, CaO, $BaSO_4$, $CeO_2$, $K_2O$, $Na_2O$, $ZrO_2$, CaO.SiO, $K_2O.(TiO_2)_n$ and $Al_2O_3.2SiO_2$ hydrophobic-treated with hexamethyldisilazane, dimethyldichlorosilane, octyltrimethoxysilane, etc. may be added to the toner mother particle as a fluidity accelerator, the amount of which is selected from a range generally used.

The releasing agent is used for preventing off-set of toner mother particle 20. Examples of the releasing agent are wax and low molecular weight olefin resin generally used in the art. Typically, the olefin resin is preferably polypropylene, polyethylene, and propylene ethylene copolymer, etc.

The charge control agent is a metal-containing azo salt, salicylic acid metal complex, Cr-containing organic dye or quaternary ammonium salt.

To prepare the non-magnetic mono-component color toner by using the composition described above, the toner mother particle comprising binder resin, colorant and releasing agent are put into a mixer such as a turbine type stirrer, a HENSCHEL mixer, a super mixer or a hybridizer.

Fatty acid metal salt, the large organic particle, small organic particle, and silica are put into the stirrer in a defined weight ratio against the toner mother particle, and then are mechanically mixed at a tip speed of 10-30 m/sec. Because high shear force is required to adhere the first and second organic particle to the toner mother particle, it is very important to control the mixing speed.

In particular, in the conventional method of preparing the toner particle adhesion is achieved by electrostatic attraction upon simple mixing, but the present invention fixes the fatty acid metal salt, organic particle, and silica on the surface of the toner mother particle through the mechanical mixing method.

The non-magnetic mono-component color toner of the present invention has an average particle size of less than 20 μm, preferably 3.0 to 9.0 μm, and is spherical with an aspect ratio of short radius against the long radius 0.3 to 0.8. The fatty acid metal salt, First organic particle and silica fill in the sunken-in part of toner mother particle, but do not uniformly coat the toner mother particle. Thus, the number average particle size of the coated toner particle does not so much increase compared to the toner mother particle, but is more spherical.

In the color toner of the present invention, the coating layer is uniformly formed on the mother particle, and thus displays a sphere-like behavior. Thus, it provides an improvement in the transfer efficiency and long-term stability, achieves high chargeability, charge maintenance, and clear color by reducing the contamination of the charging element. The toner is more environmentally friendly and can reproduce a more stable image while satisfying the need for higher resolution.

The color toner with such properties are preferably applied to the indirect transfer method or tandem method of high-speed color printing which is popular in the recent trend towards full color and high speed.

Unless specified otherwise, the average particle size mentioned in the description of the present invention is number-average particle size, and the amount of all components is parts by weight, Hereinafter, the present invention is described in more detail through examples. However, the following examples are given only for the understanding of the present invention and they do not limit the present invention.

EXAMPLE 1

1) Preparation of Magenta Toner Mother Particle 92 parts by weight of polyester resin (molecular weight=$2.5\times10^4$), 5 parts by weight of quinacridone Red 122, 1 part by weight of tertiary ammonium salt, 2 parts by weight of polypropylene having a low molecular weight were mixed using a HENSCHEL mixer. The mixture was melted and kneaded at 165 □ using a twin melt kneader, crushed using a jet mil crusher, and classified using an air classifier to obtain a toner mother particle having a volume-average particle size of 9.0 μm.

2) Preparation of Non-magnetic Mono-component Color Toner

As indicated in Table 1 with respect to 100 parts by weight of the toner mother particle prepared in the above, 5 parts by weight of fatty acid metal salt A 100 parts by weight having an average particle size 0.5 μm including Mg less than 5 wt %, 0.1 parts by weight of polyvinylidene fluoride (PVDF) having average particle size 0.1 μm as the first spherical organic particle, and 0.1 parts by weight of polytetrafluoroethylene (PTFE) having an average particle size 2.0 μm as the second spherical organic particle were coated on the toner mother particle.

In the above, 2 parts by weight of silica having an average particle size of 12 nm were stirred and mixed with the organic particles at for 5 minutes at a tip speed of at least 20 m/s, and coated on the toner mother particle to prepare the non-magnetic mono-component color toner.

TABLE 1

| Fatty acid metal salt | Metal | Metal content | Fatty acid |
|---|---|---|---|
| Fatty acid metal salt A | Mg | less than 5 wt % | caprylic acid |
| Fatty acid metal salt B | Mg | less than 5 wt % | stearic acid |
| Fatty acid metal salt C | Mg | less than 5 wt % | oleic acid |
| Fatty acid metal salt D | Ca | less than 5 wt % | iso-stearic acid |
| Fatty acid metal salt E | Ca | less than 5 wt % | stearic acid |
| Fatty acid metal salt F | Ca | 5-10% | oleic acid |
| Fatty acid metal salt G | Al | 5-10% | caproic acid |
| Fatty acid metal salt H | Al | 5-10% | stearic acid |
| Fatty acid metal salt I | Al | 5-10% | oleic acid |
| Fatty acid metal salt J | Zn | 5-10% | stearic acid |
| Fatty acid metal salt K | Zn | more than 10 wt % | lauric acid |
| Fatty acid metal salt L | Zn | more than 10 wt % | caprylic acid |
| Fatty acid metal salt M | Zn | more than 10 wt % | stearic acid |
| Fatty acid metal salt N | Pb | more than 10 wt % | stearic acid |

EXAMPLES 2~121

Examples 2-121 were performed according to substantially the same method as in Example 1, except that fatty acid metal salt and organic particle were used as shown in Table 1. The fatty acid contained Na, K, Al, Ca, Zn, Mg, Co, Fe, Mn, Ba, Vd or Sn as a metal, and caproic acid, carylic acid, lauric acid, oleic acid, stearic acid, iso-stearic acid as a fatty acid.

TABLE 2

| EXAMPLE | Fatty acid metal salt (particle size, type, amount) | First organic particle (particle size, type, amount) | Second organic particle (particle size, type, amount) |
|---|---|---|---|
| 2 | 0.5 μm, Fatty acid metal salt A, 0.5 | 2.0 μm, PMMA 0.1 | 0.1 μm, PVDF 0.1 |
| 3 | 0.5 μm, Fatty acid metal salt A 0.5 | 2.0 μm, PTFE 1.5 | 0.1 μm, PVDF 0.1 |
| 4 | 0.5 μm, Fatty acid metal salt A 0.5 | 2.0 μm, PMMA 1.5 | 0.1 μm, PVDF 0.1 |
| 5 | 0.5 μm, Fatty acid metal salt A 0.5 | 2.0 μm, PTFE 0.1 | 0.1 μm, PVDF 1.5 |
| 6 | 0.5 μm, Fatty acid metal salt A 0.5 | 2.0 μm, PMMA 0.1 | 0.1 μm, PVDF 1.5 |
| 7 | 0.5 μm, Fatty acid metal salt A 0.5 | 2.0 μm, PTFE 1.5 | 0.1 μm, PVDF 1.5 |
| 8 | 0.5 μm, Fatty acid metal salt A 0.5 | 2.0 μm, PMMA 1.5 | 0.1 μm, PVDF 1.5 |
| 9 | 0.5 μm, Fatty acid metal salt B 0.5 | 2.0 μm, PTFE 0.5 | 0.1 μm, PVDF 0.5 |
| 10 | 0.5 μm, Fatty acid metal salt B 0.5 | 2.0 μm, PMMA 0.5 | 0.1 μm, PVDF 0.5 |
| 11 | 0.5 μm, Fatty acid metal salt B 0.5 | 0.4 μm, PVDF 0.1 | 0.1 μm, PVDF 0.1 |
| 12 | 0.5 μm, Fatty acid metal salt B 0.5 | 0.4 μm, PMMA 0.1 | 0.1 μm, PVDF 0.1 |
| 13 | 0.5 μm, Fatty acid metal salt B 0.5 | 0.4 μm, PVDF 0.1 | 0.1 μm, PVDF 1.5 |
| 14 | 0.5 μm, Fatty acid metal salt B 0.5 | 0.4 μm, PMMA 0.1 | 0.1 μm, PVDF 1.5 |
| 15 | 0.5 μm, Fatty acid metal salt B 0.5 | 0.4 μm, PVDF 1.5 | 0.1 μm, PVDF 0.1 |
| 16 | 0.5 μm, Fatty acid metal salt B 0.5 | 0.4 μm, PMMA 1.5 | 0.1 μm, PVDF 0.1 |
| 17 | 0.5 μm, Fatty acid metal salt B 0.5 | 0.4 μm, PVDF 1.5 | 0.1 μm, PVDF 1.5 |
| 18 | 0.5 μm, Fatty acid metal salt C 0.5 | 0.4 μm, PMMA 1.5 | 0.1 μm, PVDF 1.5 |
| 19 | 0.5 μm, Fatty acid metal salt C 0.5 | 0.4 μm, PMMA 0.5 | 0.1 μm, PVDF 0.5 |
| 20 | 0.5 μm, Fatty acid metal salt C 0.5 | 0.4 μm, PVDF 0.1 | 0.15 μm, PMMA 0.1 |
| 21 | 0.5 μm, Fatty acid metal salt C 0.5 | 0.4 μm, PMMA 0.1 | 0.15 μm, PMMA 0.1 |
| 22 | 0.5 μm, Fatty acid metal salt D 0.5 | 0.4 μm, PVDF 1.5 | 0.15 μm, PMMA 1.5 |
| 23 | 0.5 μm, Fatty acid metal salt D 0.5 | 0.4 μm, PMMA 1.5 | 0.15 μm, PMMA 1.5 |
| 24 | 0.5 μm, Fatty acid metal salt D 0.5 | 0.4 μm, PVDF 0.1 | 0.15 μm, PMMA 1.5 |
| 25 | 0.5 μm, Fatty acid metal salt D 0.5 | 0.4 μm, PMMA 0.1 | 0.15 μm, PMMA 1.5 |
| 26 | 0.5 μm, Fatty acid metal salt D 0.5 | 0.4 μm, PVDF 1.5 | 0.15 μm, PMMA 0.1 |
| 27 | 0.5 μm, Fatty acid metal salt D 0.5 | 0.4 μm, PMMA 1.5 | 0.15 μm, PMMA 0.1 |
| 28 | 0.5 μm, Fatty acid metal salt D 0.5 | 0.4 μm, PVDF 0.5 | 0.15 μm, PMMA 0.5 |
| 29 | 0.5 μm, Fatty acid metal salt D 0.5 | 0.4 μm, PMMA 0.5 | 0.15 μm, PMMA 0.5 |
| 30 | 0.5 μm, Fatty acid metal salt E 0.5 | 2.0 μm, PTFE 0.1 | 0.15 μm, PMMA 0.1 |
| 31 | 0.5 μm, Fatty acid metal salt E 0.5 | 2.0 μm, PMMA 0.1 | 0.15 μm, PMMA 0.1 |

TABLE 2-continued

| EXAMPLE | Fatty acid metal salt (particle size, type, amount) | First organic particle (particle size, type, amount) | Second organic particle (particle size, type, amount) |
|---|---|---|---|
| 32 | 0.5 μm, Fatty acid metal salt E 0.5 | 2.0 μm, PTFE 1.5 | 0.15 μm, PMMA 1.5 |
| 33 | 0.5 μm, Fatty acid metal salt E 0.5 | 2.0 μm, PMMA 1.5 | 0.15 μm, PMMA 1.5 |
| 34 | 0.5 μm, Fatty acid metal salt E 0.5 | 2.0 μm, PTFE 0.1 | 0.15 μm, PMMA 1.5 |
| 35 | 0.5 μm, Fatty acid metal salt E 0.5 | 2.0 μm, PMMA 0.1 | 0.15 μm, PMMA 1.5 |
| 36 | 0.5 μm, Fatty acid metal salt E 0.5 | 2.0 μm, PTFE 1.5 | 0.15 μm, PMMA 0.1 |
| 37 | 0.5 μm, Fatty acid metal salt E 0.5 | 2.0 μm, PMMA 1.5 | 0.15 μm, PMMA 0.1 |
| 38 | 0.5 μm, Fatty acid metal salt E 0.5 | 2.0 μm, PTFE 0.5 | 0.15 μm, PMMA 0.5 |
| 39 | 0.5 μm, Fatty acid metal salt E 0.5 | 2.0 μm, PMMA 0.5 | 0.15 μm, PMMA 0.5 |
| 40 | 1.5 μm, Fatty acid metal salt F 1.5 | 2.0 μm, PMMA 0.1 | 0.1 μm, PVDF 0.1 |
| 41 | 1.5 μm, Fatty acid metal salt F 1.5 | 2.0 μm, PTFE 1.5 | 0.1 μm, PVDF 0.1 |
| 42 | 1.5 μm, Fatty acid metal salt F 1.5 | 2.0 μm, PMMA 1.5 | 0.1 μm, PVDF 0.1 |
| 43 | 1.5 μm, Fatty acid metal salt F 1.5 | 2.0 μm, PTFE 0.1 | 0.1 μm, PVDF 1.5 |
| 44 | 1.5 μm, Fatty acid metal salt F 1.5 | 2.0 μm, PMMA 0.1 | 0.1 μm, PVDF 1.5 |
| 45 | 1.5 μm, Fatty acid metal salt F 1.5 | 2.0 μm, PTFE 1.5 | 0.1 μm, PVDF 1.5 |
| 46 | 1.5 μm, Fatty acid metal salt F 1.5 | 2.0 μm, PMMA 1.5 | 0.1 μm, PVDF 1.5 |
| 47 | 1.5 μm, Fatty acid metal salt F 1.5 | 2.0 μm, PTFE 0.5 | 0.1 μm, PVDF 0.5 |
| 48 | 1.5 μm, Fatty acid metal salt G 1.5 | 2.0 μm, PMMA 0.5 | 0.1 μm, PVDF 0.5 |
| 49 | 1.5 μm, Fatty acid metal salt G 1.5 | 0.4 μm, PVDF 0.1 | 0.1 μm, PVDF 0.1 |
| 50 | 1.5 μm, Fatty acid metal salt G 1.5 | 0.4 μm, PMMA 0.1 | 0.1 μm, PVDF 0.1 |
| 51 | 1.5 μm, Fatty acid metal salt G 1.5 | 0.4 μm, PVDF 0.1 | 0.1 μm, PVDF 1.5 |
| 52 | 1.5 μm, Fatty acid metal salt G 1.5 | 0.4 μm, PMMA 0.1 | 0.1 μm, PVDF 1.5 |
| 53 | 1.5 μm, Fatty acid metal salt G 1.5 | 0.4 μm, PVDF 1.5 | 0.1 μm, PVDF 0.1 |
| 54 | 1.5 μm, Fatty acid metal salt G 1.5 | 0.4 μm, PMMA 1.5 | 0.1 μm, PVDF 0.1 |
| 55 | 1.5 μm, Fatty acid metal salt G 1.5 | 0.4 μm, PVDF 1.5 | 0.1 μm, PVDF 1.5 |
| 56 | 0.5 μm, Fatty acid metal salt H 0.5 | 2.0 μm, PMMA 0.1 | 0.1 μm, PVDF 0.1 |
| 57 | 0.5 μm, Fatty acid metal salt H 0.5 | 2.0 μm, PTFE 1.5 | 0.1 μm, PVDF 0.1 |
| 58 | 0.5 μm, Fatty acid metal salt H 0.5 | 2.0 μm, PMMA 1.5 | 0.1 μm, PVDF 0.1 |
| 59 | 0.5 μm, Fatty acid metal salt H 0.5 | 2.0 μm, PTFE 0.1 | 0.1 μm, PVDF 1.5 |
| 60 | 0.5 μm, Fatty acid metal salt H 0.5 | 2.0 μm, PMMA 0.1 | 0.1 μm, PVDF 1.5 |
| 61 | 0.5 μm, Fatty acid metal salt H 0.5 | 2.0 μm, PTFE 1.5 | 0.1 μm, PVDF 1.5 |
| 62 | 0.5 μm, Fatty acid metal salt H 0.5 | 2.0 μm, PMMA 1.5 | 0.1 μm, PVDF 1.5 |
| 63 | 0.5 μm, Fatty acid metal salt I 0.5 | 2.0 μm, PMMA 0.1 | 0.1 μm, PVDF 0.1 |
| 64 | 0.5 μm, Fatty acid metal salt I 0.5 | 2.0 μm, PTFE 1.5 | 0.1 μm, PVDF 0.1 |
| 65 | 0.5 μm, Fatty acid metal salt I 0.5 | 2.0 μm, PMMA 1.5 | 0.1 μm, PVDF 0.1 |
| 66 | 0.5 μm, Fatty acid metal salt I 0.5 | 2.0 μm, PTFE 0.1 | 0.1 μm, PVDF 1.5 |
| 67 | 0.5 μm, Fatty acid metal salt I 0.5 | 2.0 μm, PMMA 0.1 | 0.1 μm, PVDF 1.5 |
| 68 | 0.5 μm, Fatty acid metal salt I 0.5 | 2.0 μm, PTFE 1.5 | 0.1 μm, PVDF 1.5 |
| 69 | 0.5 μm, Fatty acid metal salt I 0.5 | 2.0 μm, PMMA 1.5 | 0.1 μm, PVDF 1.5 |
| 70 | 0.5 μm, Fatty acid metal salt J 0.5 | 2.0 μm, PMMA 0.1 | 0.1 μm, PVDF 0.1 |
| 71 | 0.5 μm, Fatty acid metal salt J 0.5 | 2.0 μm, PTFE 1.5 | 0.1 μm, PVDF 0.1 |
| 72 | 0.5 μm, Fatty acid metal salt J 0.5 | 2.0 μm, PMMA 1.5 | 0.1 μm, PVDF 0.1 |
| 73 | 0.5 μm, Fatty acid metal salt J 0.5 | 2.0 μm, PTFE 0.1 | 0.1 μm, PVDF 1.5 |
| 74 | 0.5 μm, Fatty acid metal salt J 0.5 | 2.0 μm, PMMA 0.1 | 0.1 μm, PVDF 1.5 |
| 75 | 0.5 μm, Fatty acid metal salt J 0.5 | 2.0 μm, PTFE 1.5 | 0.1 μm, PVDF 1.5 |
| 76 | 0.5 μm, Fatty acid metal salt J 0.5 | 2.0 μm, PMMA 1.5 | 0.1 μm, PVDF 1.5 |
| 77 | 0.5 μm, Fatty acid metal salt K 0.5 | 2.0 μm, PMMA 0.1 | 0.1 μm, PVDF 0.1 |
| 78 | 0.5 μm, Fatty acid metal salt K 0.5 | 2.0 μm, PTFE 1.5 | 0.1 μm, PVDF 0.1 |
| 79 | 0.5 μm, Fatty acid metal salt K 0.5 | 2.0 μm, PMMA 1.5 | 0.1 μm, PVDF 0.1 |
| 80 | 0.5 μm, Fatty acid metal salt K 0.5 | 2.0 μm, PTFE 0.1 | 0.1 μm, PVDF 1.5 |
| 81 | 0.5 μm, Fatty acid metal salt K 0.5 | 2.0 μm, PMMA 0.1 | 0.1 μm, PVDF 1.5 |
| 82 | 0.5 μm, Fatty acid metal salt K 0.5 | 2.0 μm, PTFE 1.5 | 0.1 μm, PVDF 1.5 |
| 83 | 0.5 μm, Fatty acid metal salt K 0.5 | 2.0 μm, PMMA 1.5 | 0.1 μm, PVDF 1.5 |
| 84 | 0.5 μm, Fatty acid metal salt L 0.5 | 2.0 μm, PMMA 0.1 | 0.1 μm, PVDF 0.1 |
| 85 | 0.5 μm, Fatty acid metal salt L 0.5 | 2.0 μm, PTFE 1.5 | 0.1 μm, PVDF 0.1 |
| 86 | 0.5 μm, Fatty acid metal salt L 0.5 | 2.0 μm, PMMA 1.5 | 0.1 μm, PVDF 0.1 |
| 87 | 0.5 μm, Fatty acid metal salt L 0.5 | 2.0 μm, PTFE 0.1 | 0.1 μm, PVDF 1.5 |
| 88 | 0.5 μm, Fatty acid metal salt L 0.5 | 2.0 μm, PMMA 0.1 | 0.1 μm, PVDF 1.5 |
| 89 | 0.5 μm, Fatty acid metal salt M 0.5 | 2.0 μm, PMMA 0.1 | 0.1 μm, PVDF 0.1 |
| 90 | 0.5 μm, Fatty acid metal salt M 0.5 | 2.0 μm, PTFE 1.5 | 0.1 μm, PVDF 0.1 |
| 91 | 0.5 μm, Fatty acid metal salt M 0.5 | 2.0 μm, PMMA 1.5 | 0.1 μm, PVDF 0.1 |
| 92 | 0.5 μm, Fatty acid metal salt M 0.5 | 2.0 μm, PTFE 0.1 | 0.1 μm, PVDF 1.5 |
| 93 | 0.5 μm, Fatty acid metal salt M 0.5 | 2.0 μm, PMMA 0.1 | 0.1 μm, PVDF 1.5 |
| 94 | 0.5 μm, Fatty acid metal salt N 0.5 | 2.0 μm, PMMA 0.1 | 0.1 μm, PVDF 0.1 |
| 95 | 0.5 μm, Fatty acid metal salt N 0.5 | 2.0 μm, PTFE 1.5 | 0.1 μm, PVDF 0.1 |
| 96 | 0.5 μm, Fatty acid metal salt N 0.5 | 2.0 μm, PMMA 1.5 | 0.1 μm, PVDF 0.1 |
| 97 | 0.5 μm, Fatty acid metal salt N 0.5 | 2.0 μm, PTFE 0.1 | 0.1 μm, PVDF 1.5 |
| 98 | 0.5 μm, Fatty acid metal salt N 0.5 | 2.0 μm, PMMA 0.1 | 0.1 μm, PVDF 1.5 |
| 99 | 1.5 μm, Fatty acid metal salt A 1.5 | 0.4 μm, PMMA 1.5 | 0.1 μm, PVDF 1.5 |
| 100 | 1.5 μm, Fatty acid metal salt B 1.5 | 0.4 μm, PMMA 0.5 | 0.1 μm, PVDF 0.5 |
| 101 | 1.5 μm, Fatty acid metal salt C 1.5 | 0.4 μm, PVDF 0.1 | 0.15 μm, PMMA 0.1 |
| 102 | 1.5 μm, Fatty acid metal salt D 1.5 | 0.4 μm, PMMA 0.1 | 0.15 μm, PMMA 0.1 |
| 103 | 1.5 μm, Fatty acid metal salt E 1.5 | 2.0 μm, PMMA 0.1 | 0.1 μm, PVDF 0.1 |
| 104 | 1.5 μm, Fatty acid metal salt F 1.5 | 2.0 μm, PTFE 1.5 | 0.1 μm, PVDF 0.1 |
| 105 | 1.5 μm, Fatty acid metal salt G 1.5 | 0.4 μm, PVDF 1.5 | 0.15 μm, PMMA 1.5 |
| 106 | 1.5 μm, Fatty acid metal salt H 1.5 | 0.4 μm, PMMA 1.5 | 0.15 μm, PMMA 1.5 |
| 107 | 1.5 μm, Fatty acid metal salt I 1.5 | 0.4 μm, PVDF 0.1 | 0.15 μm, PMMA 1.5 |

TABLE 2-continued

| EXAMPLE | Fatty acid metal salt (particle size, type, amount) | First organic particle (particle size, type, amount) | Second organic particle (particle size, type, amount) |
|---|---|---|---|
| 108 | 1.5 μm, Fatty acid metal salt J 1.5 | 0.4 μm, PMMA 0.1 | 0.15 μm, PMMA 1.5 |
| 109 | 1.5 μm, Fatty acid metal salt K 1.5 | 0.4 μm, PVDF 1.5 | 0.15 μm, PMMA 0.1 |
| 110 | 1.5 μm, Fatty acid metal salt L 1.5 | 0.4 μm, PMMA 1.5 | 0.15 μm, PMMA 0.1 |
| 111 | 1.5 μm, Fatty acid metal salt M 1.5 | 0.4 μm, PVDF 0.5 | 0.15 μm, PMMA 0.5 |
| 112 | 1.5 μm, Fatty acid metal salt N 1.5 | 0.4 μm, PMMA 0.5 | 0.15 μm, PMMA 0.5 |
| 113 | 1.5 μm, Fatty acid metal salt A 1.5 | 2.0 μm, PTFE 0.1 | 0.15 μm, PMMA 0.1 |
| 114 | 1.5 μm, Fatty acid metal salt B 1.5 | 2.0 μm, PMMA 0.1 | 0.15 μm, PMMA 0.1 |
| 115 | 1.5 μm, Fatty acid metal salt C 1.5 | 2.0 μm, PTFE 1.5 | 0.15 μm, PMMA 1.5 |
| 116 | 1.5 μm, Fatty acid metal salt D 1.5 | 2.0 μm, PMMA 1.5 | 0.15 μm, PMMA 1.5 |
| 117 | 1.5 μm, Fatty acid metal salt E 1.5 | 2.0 μm, PTFE 0.1 | 0.15 μm, PMMA 1.5 |
| 118 | 1.5 μm, Fatty acid metal salt F 1.5 | 2.0 μm, PMMA 0.1 | 0.15 μm, PMMA 1.5 |
| 119 | 1.5 μm, Fatty acid metal salt G 1.5 | 2.0 μm, PTFE 1.5 | 0.15 μm, PMMA 0.1 |
| 120 | 1.5 μm, Fatty acid metal salt H 1.5 | 2.0 μm, PMMA 1.5 | 0.15 μm, PMMA 0.1 |
| 121 | 1.5 μm, Fatty acid metal salt I 1.5 | 2.0 μm, PTFE 0.5 | 0.15 μm, PMMA 0.5 |

PMMA: polymethylmethacrylate
PVDF: polyvinylidene fluoride
PTFE: polytetrafluoroetylene

COMPARATIVE EXAMPLES

The comparative examples were performed substantially in the same method as in Example 1, except that fatty acid metal salt and organic particles were as indicated in Table 3.

TABLE 3

| Comparative Example | Fatty acid metal salt (particle size, type, amount) | First organic particle (particle size, type, amount) | Second organic particle (particle size, type, amount) |
|---|---|---|---|
| 1 | x | 0.15 μm, PMMA 0.5 | 0.1 μm, PVDF 0.5 |
| 2 | x | 0.15 μm, PMMA 1.5 | 0.1 μm, PVDF 1.5 |
| 3 | x | 0.4 μm, PMMA 0.5 | 0.1 μm, PVDF 0.5 |
| 4 | x | 0.4 μm, PMMA 1.5 | 0.2 μm, PVDF 1.5 |
| 5 | x | 2.0 μm, PMMA 0.5 | 2.0 μm, PMMA 0.5 |
| 6 | x | 2.0 μm, PMMA 1.5 | 2.0 μm, PMMA 1.5 |
| 7 | x | 4.0 μm, PTFE 0.5 | 4.0 μm, PMMA 0.5 |
| 8 | x | 4.0 μm, PTFE 1.5 | 4.0 μm, PMMA 1.5 |
| 9 | x | 0.4 μm, PVDF 1.0 | 0.1 μm, PVDF 0.05 |
| 10 | x | 0.4 μm, PVDF 1.0 | 0.1 μm, PVDF 2.0 |
| 11 | x | 0.4 μm, PMMA 1.0 | 0.1 μm, PVDF 0.05 |
| 12 | x | 0.4 μm, PMMA 1.0 | 0.1 μm, PVDF 2.0 |
| 13 | x | 2.0 μm, PTFE 1.0 | 0.1 μm, PVDF 0.05 |
| 14 | x | 2.0 μm, PMMA 1.0 | 0.1 μm, PVDF 2.0 |
| 15 | x | 4.0 μm, PMMA 1.0 | 0.1 μm, PVDF 0.5 |
| 16 | x | 4.0 μm, PTFE 1.0 | 0.1 μm, PVDF 0.5 |
| 17 | x | 0.4 μm, PVDF 1.0 | 0.15 μm, PMMA 0.05 |
| 18 | x | 0.4 μm, PVDF 1.0 | 0.15 μm, PMMA 2.0 |
| 19 | x | 0.4 μm, PMMA 1.0 | 0.15 μm, PMMA 0.05 |
| 20 | x | 0.4 μm, PMMA 1.0 | 0.15 μm, PMMA 2.0 |
| 21 | x | 2.0 μm, PTFE 1.0 | 0.15 μm, PMMA 0.05 |
| 22 | x | 2.0 μm, PMMA 1.0 | 0.15 μm, PMMA 2.0 |
| 23 | x | 4.0 μm, PMMA 1.0 | 0.15 μm, PMMA 0.5 |
| 24 | x | 4.0 μm, PTFE 1.0 | 0.15 μm, PMMA 0.5 |
| 25 | x | 0.4 μm, PVDF 0.05 | 0.1 μm, PVDF 0.5 |
| 26 | x | 0.4 μm, PVDF 2.0 | 0.1 μm, PVDF 0.5 |
| 27 | x | 0.4 μm, PMMA 0.05 | 0.1 μm, PVDF 0.5 |
| 28 | x | 0.4 μm, PMMA 2.0 | 0.1 μm, PVDF 0.5 |
| 29 | x | 2.0 μm, PTFE 0.05 | 0.1 μm, PVDF 0.5 |
| 30 | x | 2.0 μm, PTFE 2.0 | 0.1 μm, PVDF 0.5 |
| 31 | x | 2.0 μm, PMMA 0.05 | 0.1 μm, PVDF 0.5 |
| 32 | x | 2.0 μm, PMMA 2.0 | 0.1 μm, PVDF 0.5 |
| 33 | x | 0.4 μm, PVDF 0.05 | 0.15 μm, PMMA 0.5 |
| 34 | x | 0.4 μm, PVDF 2.0 | 0.15 μm, PMMA 0.5 |
| 35 | x | 0.4 μm, PMMA 0.05 | 0.15 μm, PMMA 0.5 |
| 36 | x | 0.4 μm, PMMA 2.0 | 0.15 μm, PMMA 0.5 |
| 37 | x | 2.0 μm, PTFE 0.05 | 0.15 μm, PMMA 0.5 |
| 38 | x | 2.0 μm, PTFE 2.0 | 0.15 μm, PMMA 0.5 |
| 39 | x | 2.0 μm, PMMA 0.05 | 0.15 μm, PMMA 0.5 |
| 40 | x | 4.0 μm, PMMA 0.05 | 0.1 μm, PVDF 0.05 |
| 41 | x | 4.0 μm, PTFE 0.05 | 0.1 μm, PVDF 0.05 |
| 42 | x | 4.0 μm, PMMA 2.0 | 0.1 μm, PVDF 0.05 |

TABLE 3-continued

| Comparative Example | Fatty acid metal salt (particle size, type, amount) | First organic particle (particle size, type, amount) | Second organic particle (particle size, type, amount) |
|---|---|---|---|
| 43 | x | 4.0 μm, PTFE 2.0 | 0.1 μm, PVDF 0.05 |
| 44 | 0.5 μm, Fatty acid metal salt B 0.5 | 0.15 μm, PMMA 0.5 | 0.1 μm, PVDF 0.5 |
| 45 | 0.5 μm, Fatty acid metal salt C 0.5 | 0.15 μm, PMMA 1.5 | 0.1 μm, PVDF 1.5 |
| 46 | 0.5 μm, Fatty acid metal salt D 0.5 | 0.4 μm, PMMA 0.5 | 0.4 μm, PVDF 0.5 |
| 47 | 0.5 μm, Fatty acid metal salt E 0.5 | 0.4 μm, PMMA 1.5 | 0.4 μm, PVDF 1.5 |
| 48 | 0.5 μm, Fatty acid metal salt F 0.5 | 2.0 μm, PMMA 0.5 | 2.0 μm, PMMA 0.5 |
| 49 | 0.5 μm, Fatty acid metal salt G 0.5 | 0.15 μm, PMMA 0.5 | 0.1 μm, PVDF 0.5 |
| 50 | 0.5 μm, Fatty acid metal salt H 0.5 | 0.15 μm, PMMA 1.5 | 0.1 μm, PVDF 1.5 |
| 51 | 0.5 μm, Fatty acid metal salt I 0.5 | 0.4 μm, PMMA 0.5 | 0.4 μm, PVDF 0.5 |
| 52 | 0.5 μm, Fatty acid metal salt J 0.5 | 0.4 μm, PMMA 1.5 | 0.4 μm, PVDF 1.5 |
| 53 | 0.5 μm, Fatty acid metal salt K 0.5 | 2.0 μm, PMMA 0.5 | 2.0 μm, PMMA 0.5 |
| 54 | 0.5 μm, Fatty acid metal salt L 0.5 | 0.15 μm, PMMA 0.5 | 0.1 μm, PVDF 0.5 |
| 55 | 0.5 μm, Fatty acid metal salt M 0.5 | 0.15 μm, PMMA 1.5 | 0.1 μm, PVDF 1.5 |
| 56 | 0.5 μm, Fatty acid metal salt F 0.5 | 2.0 μm, PTFE 1.0 | 0.1 μm, PVDF 0.05 |
| 57 | 0.5 μm, Fatty acid metal salt G 0.5 | 2.0 μm, PMMA 1.0 | 0.1 μm, PVDF 2.0 |
| 58 | 0.5 μm, Fatty acid metal salt A 0.5 | 2.0 μm, PMMA 1.0 | 0.1 μm, PVDF 2.0 |
| 59 | 0.5 μm, Fatty acid metal salt B 0.5 | 2.0 μm, PMMA 1.0 | 0.1 μm, PVDF 2.0 |
| 60 | 0.5 μm, Fatty acid metal salt C 0.5 | 2.0 μm, PMMA 1.0 | 0.1 μm, PVDF 2.0 |
| 61 | 0.5 μm, Fatty acid metal salt D 0.5 | 2.0 μm, PMMA 1.0 | 0.1 μm, PVDF 2.0 |
| 62 | 0.5 μm, Fatty acid metal salt E 0.5 | 2.0 μm, PMMA 1.0 | 0.1 μm, PVDF 2.0 |
| 63 | 0.5 μm, Fatty acid metal salt F 0.5 | 2.0 μm, PMMA 1.0 | 0.1 μm, PVDF 2.0 |
| 64 | 0.5 μm, Fatty acid metal salt G 0.5 | 2.0 μm, PMMA 1.0 | 0.1 μm, PVDF 2.0 |
| 65 | 0.5 μm, Fatty acid metal salt A 0.5 | 4.0 μm, PMMA 1.0 | 0.1 μm, PVDF 0.5 |
| 66 | 0.5 μm, Fatty acid metal salt B 0.5 | 4.0 μm, PTFE 1.0 | 0.1 μm, PVDF 0.5 |
| 67 | 0.5 μm, Fatty acid metal salt C 0.5 | 0.4 μm, PVDF 1.0 | 0.15 μm, PMMA 0.05 |
| 68 | 0.5 μm, Fatty acid metal salt D 0.5 | 0.4 μm, PVDF 1.0 | 0.15 μm, PMMA 2.0 |
| 69 | 0.5 μm, Fatty acid metal salt E 0.5 | 0.4 μm, PMMA 1.0 | 0.15 μm, PMMA 0.05 |
| 70 | 0.5 μm, Fatty acid metal salt F 0.5 | 0.4 μm, PMMA 1.0 | 0.15 μm, PMMA 2.0 |
| 71 | 0.5 μm, Fatty acid metal salt G 0.5 | 2.0 μm, PTFE 1.0 | 0.15 μm, PMMA 0.05 |
| 72 | 0.5 μm, Fatty acid metal salt A 0.5 | 2.0 μm, PTFE 1.0 | 0.15 μm, PMMA 0.05 |
| 73 | 0.5 μm, Fatty acid metal salt B 0.5 | 2.0 μm, PTFE 1.0 | 0.15 μm, PMMA 0.05 |
| 74 | 0.5 μm, Fatty acid metal salt C 0.5 | 2.0 μm, PTFE 1.0 | 0.15 μm, PMMA 0.05 |
| 75 | 0.5 μm, Fatty acid metal salt D 0.5 | 2.0 μm, PTFE 1.0 | 0.15 μm, PMMA 0.05 |
| 76 | 0.5 μm, Fatty acid metal salt E 0.5 | 4.0 μm, PMMA 1.0 | 0.1 μm, PVDF 0.5 |
| 77 | 0.5 μm, Fatty acid metal salt F 0.5 | 4.0 μm, PMMA 1.0 | 0.1 μm, PVDF 0.5 |
| 78 | 0.5 μm, Fatty acid metal salt G 0.5 | 4.0 μm, PMMA 1.0 | 0.1 μm, PVDF 0.5 |
| 79 | 0.5 μm, Fatty acid metal salt C 0.5 | 2.0 μm, PMMA 1.0 | 0.15 μm, PMMA 2.0 |
| 80 | 0.5 μm, Fatty acid metal salt B 0.5 | 4.0 μm, PMMA 1.0 | 0.15 μm, PMMA 0.5 |
| 81 | 0.5 μm, Fatty acid metal salt C 0.5 | 4.0 μm, PTFE 1.0 | 0.15 μm, PMMA 0.5 |
| 82 | 0.5 μm, Fatty acid metal salt D 0.5 | 0.4 μm, PVDF 0.05 | 0.1 μm, PVDF 0.5 |
| 83 | 0.5 μm, Fatty acid metal salt E 0.5 | 0.4 μm, PVDF 2.0 | 0.1 μm, PVDF 0.5 |
| 84 | 0.5 μm, Fatty acid metal salt F 0.5 | 0.4 μm, PMMA 0.05 | 0.1 μm, PVDF 0.5 |
| 85 | 0.5 μm, Fatty acid metal salt G 0.5 | 0.4 μm, PMMA 2.0 | 0.1 μm, PVDF 0.5 |
| 86 | 0.5 μm, Fatty acid metal salt F 0.5 | 2.0 μm, PTFE 0.05 | 0.1 μm, PVDF 0.5 |
| 87 | 0.5 μm, Fatty acid metal salt B 0.5 | 2.0 μm, PTFE 2.0 | 0.1 μm, PVDF 0.5 |
| 88 | 0.5 μm, Fatty acid metal salt C 0.5 | 2.0 μm, PMMA 0.05 | 0.1 μm, PVDF 0.5 |
| 89 | 0.5 μm, Fatty acid metal salt D 0.5 | 2.0 μm, PMMA 2.0 | 0.1 μm, PVDF 0.5 |
| 90 | 0.5 μm, Fatty acid metal salt E 0.5 | 0.4 μm, PVDF 0.05 | 0.15 μm, PMMA 0.5 |
| 91 | 0.5 μm, Fatty acid metal salt F 0.5 | 0.4 μm, PVDF 2.0 | 0.15 μm, PMMA 0.5 |
| 92 | 0.5 μm, Fatty acid metal salt G 0.5 | 0.4 μm, PMMA 0.05 | 0.15 μm, PMMA 0.5 |
| 93 | 0.5 μm, Fatty acid metal salt B 0.5 | 2.0 μm, PMMA 0.05 | 0.1 μm, PVDF 0.5 |
| 94 | 0.5 μm, Fatty acid metal salt C 0.5 | 2.0 μm, PMMA 0.05 | 0.1 μm, PVDF 0.5 |
| 95 | 0.5 μm, Fatty acid metal salt D 0.5 | 2.0 μm, PMMA 0.05 | 0.1 μm, PVDF 0.5 |
| 96 | 0.5 μm, Fatty acid metal salt E 0.5 | 2.0 μm, PMMA 0.05 | 0.1 μm, PVDF 0.5 |
| 97 | 0.5 μm, Fatty acid metal salt F 0.5 | 2.0 μm, PMMA 2.0 | 0.1 μm, PVDF 0.5 |
| 98 | 0.5 μm, Fatty acid metal salt B 0.5 | 2.0 μm, PMMA 2.0 | 0.1 μm, PVDF 0.5 |
| 99 | 0.5 μm, Fatty acid metal salt C 0.5 | 2.0 μm, PMMA 2.0 | 0.1 μm, PVDF 0.5 |
| 100 | 0.5 μm, Fatty acid metal salt D 0.5 | 0.4 μm, PMMA 2.0 | 0.15 μm, PMMA 0.5 |
| 101 | 0.5 μm, Fatty acid metal salt B 0.5 | 2.0 μm, PTFE 0.05 | 0.15 μm, PMMA 0.5 |
| 102 | 0.5 μm, Fatty acid metal salt C 0.5 | 2.0 μm, PTFE 2.0 | 0.15 μm, PMMA 0.5 |
| 103 | 0.5 μm, Fatty acid metal salt D 0.5 | 2.0 μm, PMMA 0.05 | 0.15 μm, PMMA 0.5 |
| 104 | 0.5 μm, Fatty acid metal salt E 0.5 | 4.0 μm, PMMA 0.05 | 0.1 μm, PVDF 0.05 |
| 105 | 0.5 μm, Fatty acid metal salt F 0.5 | 4.0 μm, PTFE 0.05 | 0.1 μm, PVDF 0.05 |
| 106 | 0.5 μm, Fatty acid metal salt G 0.5 | 4.0 μm, PMMA 2.0 | 0.1 μm, PVDF 0.05 |
| 107 | 0.5 μm, Fatty acid metal salt B 0.5 | 0.4 μm, PMMA 2.0 | 0.15 μm, PMMA 0.5 |
| 108 | 0.5 μm, Fatty acid metal salt C 0.5 | 2.0 μm, PTFE 0.05 | 0.15 μm, PMMA 0.5 |
| 109 | 0.5 μm, Fatty acid metal salt D 0.5 | 2.0 μm, PTFE 0.05 | 0.15 μm, PMMA 0.5 |
| 110 | 0.5 μm, Fatty acid metal salt E 0.5 | 2.0 μm, PTFE 0.05 | 0.15 μm, PMMA 0.5 |
| 111 | 0.5 μm, Fatty acid metal salt F 0.5 | 2.0 μm, PTFE 0.05 | 0.15 μm, PMMA 0.5 |
| 112 | 3.5 μm, Fatty acid metal salt A 0.5 | 4.0 μm, PTFE 0.05 | 0.1 μm, PVDF 0.05 |
| 113 | 3.5 μm, Fatty acid metal salt G 0.5 | 4.0 μm, PTFE 0.05 | 0.1 μm, PVDF 0.05 |
| 114 | 0.5 μm, Fatty acid metal salt C 0.5 | 4.0 μm, PTFE 2.0 | 0.1 μm, PVDF 0.05 |
| 115 | 3.5 μm, Fatty acid metal salt B 0.5 | 0.15 μm, PMMA 0.5 | 0.1 μm, PVDF 0.5 |
| 116 | 3.5 μm, Fatty acid metal salt C 0.5 | 0.15 μm, PMMA 1.5 | 0.1 μm, PVDF 1.5 |
| 117 | 3.5 μm, Fatty acid metal salt D 0.5 | 0.4 μm, PMMA 0.5 | 0.4 μm, PVDF 0.5 |
| 118 | 3.5 μm, Fatty acid metal salt E 0.5 | 0.4 μm, PMMA 1.5 | 0.4 μm, PVDF 1.5 |

TABLE 3-continued

| Comparative Example | Fatty acid metal salt (particle size, type, amount) | First organic particle (particle size, type, amount) | Second organic particle (particle size, type, amount) |
|---|---|---|---|
| 119 | 3.5 μm, Fatty acid metal salt F 0.5 | 2.0 μm, PMMA 0.5 | 2.0 μm, PMMA 0.5 |
| 120 | 3.5 μm, Fatty acid metal salt G 0.5 | 2.0 μm, PMMA 1.5 | 2.0 μm, PMMA 1.5 |
| 121 | 3.5 μm, Fatty acid metal salt B 0.5 | 0.15 μm, PMMA 0.5 | 0.1 μm, PVDF 0.5 |
| 122 | 3.5 μm, Fatty acid metal salt C 0.5 | 0.15 μm, PMMA 0.5 | 0.1 μm, PVDF 0.5 |
| 123 | 3.5 μm, Fatty acid metal salt D 0.5 | 0.15 μm, PMMA 0.5 | 0.1 μm, PVDF 0.5 |
| 124 | 3.5 μm, Fatty acid metal salt E 0.5 | 0.4 μm, PMMA 0.5 | 0.3 μm, PVDF 0.5 |
| 125 | 3.5 μm, Fatty acid metal salt F 0.5 | 0.4 μm, PMMA 0.5 | 0.4 μm, PVDF 0.5 |
| 126 | 3.5 μm, Fatty acid metal salt G 0.5 | 0.4 μm, PMMA 0.5 | 0.4 μm, PVDF 0.5 |
| 127 | 3.5 μm, Fatty acid metal salt B 0.5 | 0.15 μm, PMMA 0.5 | 0.1 μm, PVDF 0.5 |
| 128 | 3.5 μm, Fatty acid metal salt C 0.5 | 4.0 μm, PTFE 0.5 | 4.0 μm, PMMA 0.5 |
| 129 | 3.5 μm, Fatty acid metal salt D 0.5 | 4.0 μm, PTFE 1.5 | 4.0 μm, PMMA 1.5 |
| 130 | 3.5 μm, Fatty acid metal salt E 0.5 | 0.4 μm, PVDF 1.0 | 0.1 μm, PVDF 0.05 |
| 131 | 3.5 μm, Fatty acid metal salt F 0.5 | 0.4 μm, PVDF 1.0 | 0.1 μm, PVDF 2.0 |
| 132 | 3.5 μm, Fatty acid metal salt G 0.5 | 0.4 μm, PMMA 1.0 | 0.1 μm, PVDF 0.05 |
| 133 | 3.5 μm, Fatty acid metal salt A 0.5 | 0.4 μm, PMMA 1.0 | 0.1 μm, PVDF 2.0 |
| 134 | 3.5 μm, Fatty acid metal salt B 0.5 | 2.0 μm, PTFE 1.0 | 0.1 μm, PVDF 0.05 |
| 135 | 3.5 μm, Fatty acid metal salt C 0.5 | 0.15 μm, PMMA 0.5 | 0.1 μm, PVDF 0.5 |
| 136 | 3.5 μm, Fatty acid metal salt D 0.5 | 0.15 μm, PMMA 0.5 | 0.1 μm, PVDF 0.5 |
| 137 | 3.5 μm, Fatty acid metal salt E 0.5 | 0.15 μm, PMMA 0.5 | 0.1 μm, PVDF 0.5 |
| 138 | 3.5 μm, Fatty acid metal salt F 0.5 | 4.0 μm, PTFE 0.5 | 4.0 μm, PMMA 0.5 |
| 139 | 3.5 μm, Fatty acid metal salt G 0.5 | 4.0 μm, PTFE 0.5 | 4.0 μm, PMMA 0.5 |
| 140 | 3.5 μm, Fatty acid metal salt F 2.5 | 4.0 μm, PTFE 0.5 | 4.0 μm, PMMA 0.5 |
| 141 | 3.5 μm, Fatty acid metal salt G 2.5 | 4.0 μm, PTFE 0.5 | 4.0 μm, PMMA 0.5 |
| 142 | 3.5 μm, Fatty acid metal salt A 0.5 | 2.0 μm, PMMA 1.0 | 0.1 μm, PVDF 2.0 |
| 143 | 3.5 μm, Fatty acid metal salt B 2.5 | 4.0 μm, PMMA 1.0 | 0.1 μm, PVDF 0.5 |
| 144 | 3.5 μm, Fatty acid metal salt C 2.5 | 4.0 μm, PTFE 1.0 | 0.1 μm, PVDF 0.5 |
| 145 | 3.5 μm, Fatty acid metal salt D 2.5 | 0.4 μm, PVDF 1.0 | 0.15 μm, PMMA 0.05 |
| 146 | 3.5 μm, Fatty acid metal salt E 2.5 | 0.4 μm, PVDF 1.0 | 0.15 μm, PMMA 2.0 |
| 147 | 3.5 μm, Fatty acid metal salt F 2.5 | 0.4 μm, PMMA 1.0 | 0.15 μm, PMMA 0.05 |
| 148 | 3.5 μm, Fatty acid metal salt G 2.5 | 0.4 μm, PMMA 1.0 | 0.15 μm, PMMA 2.0 |
| 149 | 3.5 μm, Fatty acid metal salt A 2.5 | 2.0 μm, PTFE 1.0 | 0.15 μm, PMMA 0.05 |
| 150 | 3.5 μm, Fatty acid metal salt B 2.5 | 2.0 μm, PMMA 1.0 | 0.15 μm, PMMA 2.0 |
| 151 | 3.5 μm, Fatty acid metal salt C 2.5 | 4.0 μm, PMMA 1.0 | 0.15 μm, PMMA 0.5 |
| 152 | 3.5 μm, Fatty acid metal salt D 2.5 | 4.0 μm, PTFE 1.0 | 0.15 μm, PMMA 0.5 |
| 153 | 0.03 μm, Fatty acid metal salt E 0.2 | 0.1 μm, PVDF 0.5 | 0.15 μm, PMMA 0.5 |
| 154 | 0.03 μm, Fatty acid metal salt F 0.2 | 0.1 μm, PVDF 1.5 | 0.15 μm, PMMA 1.5 |
| 155 | 0.03 μm, Fatty acid metal salt G 0.2 | 0.4 μm, PVDF 0.5 | 0.2 μm, PMMA 0.5 |
| 156 | 0.03 μm, Fatty acid metal salt A 0.2 | 0.4 μm, PVDF 1.5 | 0.4 μm, PMMA 1.5 |
| 157 | 0.03 μm, Fatty acid metal salt B 0.2 | 2.0 μm, PMMA 0.5 | 2.0 μm, PMMA 0.5 |
| 158 | 0.03 μm, Fatty acid metal salt C 0.2 | 2.0 μm, PMMA 1.5 | 2.0 μm, PMMA 1.5 |
| 159 | 0.03 μm, Fatty acid metal salt D 0.2 | 4.0 μm, PMMA 0.5 | 4.0 μm, PTFE 0.5 |
| 160 | 0.03 μm, Fatty acid metal salt E 0.2 | 4.0 μm, PMMA 1.5 | 4.0 μm, PTFE 1.5 |
| 161 | 0.03 μm, Fatty acid metal salt F 0.2 | 0.1 μm, PVDF 0.05 | 0.2 μm, PVDF 1.0 |
| 162 | 0.03 μm, Fatty acid metal salt G 0.2 | 0.1 μm, PVDF 2.0 | 0.3 μm, PVDF 1.0 |
| 163 | 0.03 μm, Fatty acid metal salt A 0.2 | 0.1 μm, PVDF 0.05 | 0.2 μm, PMMA 1.0 |
| 164 | 0.03 μm, Fatty acid metal salt B 0.2 | 0.1 μm, PVDF 2.0 | 0.3 μm, PMMA 1.0 |
| 165 | 0.03 μm, Fatty acid metal salt C 0.2 | 0.1 μm, PVDF 0.05 | 2.0 μm, PTFE 1.0 |
| 166 | 0.03 μm, Fatty acid metal salt D 0.2 | 0.1 μm, PVDF 2.0 | 2.0 μm, PMMA 1.0 |
| 167 | 0.03 μm, Fatty acid metal salt E 0.2 | 0.1 μm, PVDF 0.5 | 4.0 μm, PMMA 1.0 |
| 168 | 0.03 μm, Fatty acid metal salt F 0.2 | 0.1 μm, PVDF 0.5 | 4.0 μm, PTFE 1.0 |
| 169 | 0.03 μm, Fatty acid metal salt G 0.2 | 0.15 μm, PMMA 0.05 | 0.4 μm, PVDF 1.0 |
| 170 | 0.03 μm, Fatty acid metal salt A 0.2 | 0.15 μm, PMMA 2.0 | 0.4 μm, PVDF 1.0 |
| 171 | 0.03 μm, Fatty acid metal salt B 0.2 | 0.15 μm, PMMA 0.05 | 0.4 μm, PMMA 1.0 |
| 172 | 0.03 μm, Fatty acid metal salt C 0.2 | 0.15 μm, PMMA 2.0 | 0.2 μm, PMMA 1.0 |
| 173 | 0.03 μm, Fatty acid metal salt D 0.2 | 0.1 μm, PVDF 0.5 | 0.15 μm, PMMA 0.5 |
| 174 | 0.03 μm, Fatty acid metal salt E 0.2 | 0.1 μm, PVDF 1.5 | 0.15 μm, PMMA 1.5 |
| 175 | 0.03 μm, Fatty acid metal salt F 0.2 | 0.4 μm, PVDF 0.5 | 0.3 μm, PMMA 0.5 |
| 176 | 0.03 μm, Fatty acid metal salt G 0.2 | 0.4 μm, PVDF 1.5 | 0.4 μm, PMMA 1.5 |
| 177 | 0.03 μm, Fatty acid metal salt A 0.2 | 2.0 μm, PMMA 0.5 | 2.0 μm, PMMA 0.5 |
| 178 | 0.03 μm, Fatty acid metal salt B 0.2 | 2.0 μm, PMMA 1.5 | 2.0 μm, PMMA 1.5 |
| 179 | 0.03 μm, Fatty acid metal salt C 0.2 | 4.0 μm, PMMA 0.5 | 4.0 μm, PTFE 0.5 |
| 180 | 0.03 μm, Fatty acid metal salt D 0.2 | 4.0 μm, PMMA 1.5 | 4.0 μm, PTFE 1.5 |
| 181 | 0.03 μm, Fatty acid metal salt E 0.2 | 0.1 μm, PVDF 0.05 | 0.4 μm, PVDF 1.0 |
| 182 | 0.03 μm, Fatty acid metal salt F 0.2 | 0.1 μm, PVDF 2.0 | 0.4 μm, PVDF 1.0 |
| 183 | 0.03 μm, Fatty acid metal salt G 0.2 | 0.1 μm, PVDF 0.05 | 0.4 μm, PMMA 1.0 |
| 184 | 0.03 μm, Fatty acid metal salt A 0.2 | 0.1 μm, PVDF 2.0 | 0.4 μm, PMMA 1.0 |
| 185 | 0.03 μm, Fatty acid metal salt B 0.2 | 0.1 μm, PVDF 0.05 | 2.0 μm, PTFE 1.0 |
| 186 | 0.03 μm, Fatty acid metal salt C 0.2 | 0.1 μm, PVDF 2.0 | 2.0 μm, PMMA 1.0 |
| 187 | 0.03 μm, Fatty acid metal salt D 0.2 | 0.1 μm, PVDF 0.5 | 4.0 μm, PMMA 1.0 |
| 188 | 0.03 μm, Fatty acid metal salt E 0.2 | 0.1 μm, PVDF 0.5 | 4.0 μm, PTFE 1.0 |
| 189 | 0.03 μm, Fatty acid metal salt F 0.05 | 0.15 μm, PMMA 0.05 | 0.5 μm, PVDF 1.0 |
| 190 | 0.03 μm, Fatty acid metal salt G 0.05 | 0.15 μm, PMMA 2.0 | 0.5 μm, PVDF 1.0 |
| 191 | 0.03 μm, Fatty acid metal salt A 0.05 | 0.15 μm, PMMA 0.05 | 0.5 μm, PMMA 1.0 |
| 192 | 0.03 μm, Fatty acid metal salt B 0.05 | 0.15 μm, PMMA 2.0 | 0.4 μm, PMMA 1.0 |
| 193 | 0.03 μm, Fatty acid metal salt C 0.05 | 0.15 μm, PMMA 0.05 | 2.0 μm, PTFE 1.0 |

TEST EXAMPLE 1

5,000 sheets of paper was printed with each of the non-magnetic mono-component color toner prepared in Examples 1-121 and Comparative Examples 1-193 using a contact type of non-magnetic mono-component development printer (HP 4600, Hewlett-Packard) at room temperature and humidity (20 □, 55% RH). Image density, printing efficiency, and long-term stability were tested according to the following methods. The results are given in Tables 4 and 5 below.

1) Charging Element Contamination

PCR contamination, and melting and contamination of sleeve surface were observed according to the following criteria.

| | PCR contamination | Melting and contamination of the sleeve surface |
|---|---|---|
| A | Little | Little |
| B | Some | Some |
| C | high | high |
| D | Very high | Very high |

2) Image Density (I.D)

Solid area was measured using a Macbeth reflectance densitometer RD918.

A: the image density is equal to or more than 1.4

B: the image density is equal to or more than 1.3

C: the image density is equal to or less than 1.2

D: the image density is equal to or less than 1.0

3) Transfer Efficiency

Of the 5,000 sheets of paper, printing efficiency was calculated by counting the number of wasted sheets per each 500 sheets.

A: The transfer efficiency is equal to or more than 80%

B: The transfer efficiency is 70□80%

C: The transfer efficiency is 60□70%

D: The transfer efficiency is 50□60%

4) Long-term Stability

Whether I.D. and printing efficiency were maintained after printing 5,000 sheets was observed.

A: I.D≧1.4, and Transfer efficiency ≧75%;

B: I.D≧1.3, and Transfer efficiency ≧70%;

C: I.D≦1.2, and Transfer efficiency ≧60%;

D: I.D≦1.0, and Transfer efficiency ≧40%;

TABLE 4

| | Charging element contamination | Image density | Transfer efficiency | Long-term stability |
|---|---|---|---|---|
| EXAMPLE 1 | A | B | A | A |
| EXAMPLE 2 | A | B | A | A |
| EXAMPLE 3 | A | A | A | A |
| EXAMPLE 4 | A | A | A | A |
| EXAMPLE 5 | A | A | B | A |
| EXAMPLE 6 | A | A | B | A |
| EXAMPLE 7 | A | A | A | A |
| EXAMPLE 8 | A | B | A | A |
| EXAMPLE 9 | A | A | A | A |
| EXAMPLE 10 | A | A | A | A |
| EXAMPLE 11 | A | B | A | A |
| EXAMPLE 12 | A | A | A | B |
| EXAMPLE 13 | A | A | A | A |
| EXAMPLE 14 | A | A | A | A |
| EXAMPLE 15 | B | A | B | A |
| EXAMPLE 16 | A | A | A | A |

TABLE 4-continued

| | Charging element contamination | Image density | Transfer efficiency | Long-term stability |
|---|---|---|---|---|
| EXAMPLE 17 | A | A | A | A |
| EXAMPLE 18 | A | B | A | A |
| EXAMPLE 19 | A | A | A | B |
| EXAMPLE 20 | A | A | A | A |
| EXAMPLE 21 | B | A | A | A |
| EXAMPLE 22 | A | A | A | A |
| EXAMPLE 23 | A | A | A | B |
| EXAMPLE 24 | A | A | A | A |
| EXAMPLE 25 | B | A | A | A |
| EXAMPLE 26 | A | A | A | A |
| EXAMPLE 27 | A | B | A | A |
| EXAMPLE 28 | A | A | A | A |
| EXAMPLE 29 | A | A | A | A |
| EXAMPLE 30 | A | B | A | A |
| EXAMPLE 31 | A | A | A | A |
| EXAMPLE 32 | A | B | A | A |
| EXAMPLE 33 | A | A | A | A |
| EXAMPLE 34 | A | A | A | A |
| EXAMPLE 35 | A | B | A | A |
| EXAMPLE 36 | A | A | A | A |
| EXAMPLE 37 | A | A | A | A |
| EXAMPLE 38 | A | A | A | A |
| EXAMPLE 39 | A | A | A | A |
| EXAMPLE 40 | B | A | A | A |
| EXAMPLE 41 | A | A | A | A |
| EXAMPLE 42 | A | A | A | A |
| EXAMPLE 43 | A | A | A | A |
| EXAMPLE 44 | A | A | A | A |
| EXAMPLE 45 | B | A | A | A |
| EXAMPLE 46 | A | A | A | A |
| EXAMPLE 47 | A | A | A | A |
| EXAMPLE 48 | B | A | A | A |
| EXAMPLE 49 | A | A | B | A |
| EXAMPLE 50 | A | A | A | A |
| EXAMPLE 51 | A | A | A | A |
| EXAMPLE 52 | B | A | A | A |
| EXAMPLE 53 | A | A | A | A |
| EXAMPLE 54 | A | A | A | A |
| EXAMPLE 55 | B | A | A | B |
| EXAMPLE 56 | A | A | A | A |
| EXAMPLE 57 | A | A | A | A |
| EXAMPLE 58 | A | A | A | A |
| EXAMPLE 59 | A | A | B | A |
| EXAMPLE 60 | A | A | A | A |
| EXAMPLE 61 | A | A | A | A |
| EXAMPLE 62 | A | A | A | A |
| EXAMPLE 63 | A | A | A | A |
| EXAMPLE 64 | A | A | A | A |
| EXAMPLE 65 | A | A | A | A |
| EXAMPLE 66 | B | A | A | A |
| EXAMPLE 67 | A | A | A | A |
| EXAMPLE 68 | A | A | B | A |
| EXAMPLE 69 | A | A | A | A |
| EXAMPLE 70 | A | B | A | A |
| EXAMPLE 71 | A | A | A | A |
| EXAMPLE 72 | A | A | B | A |
| EXAMPLE 73 | A | A | A | A |
| EXAMPLE 74 | A | A | A | A |
| EXAMPLE 75 | A | B | A | A |
| EXAMPLE 76 | A | B | B | A |
| EXAMPLE 77 | B | A | A | A |
| EXAMPLE 78 | A | A | A | A |
| EXAMPLE 79 | A | A | A | A |
| EXAMPLE 80 | A | A | A | A |
| EXAMPLE 81 | A | B | A | A |
| EXAMPLE 82 | A | A | B | A |
| EXAMPLE 83 | A | A | A | B |
| EXAMPLE 84 | B | A | A | A |
| EXAMPLE 85 | A | A | A | B |
| EXAMPLE 86 | A | A | A | A |
| EXAMPLE 87 | A | B | A | A |
| EXAMPLE 88 | A | A | B | A |
| EXAMPLE 89 | A | B | B | A |
| EXAMPLE 90 | B | A | A | A |
| EXAMPLE 91 | B | B | A | A |
| EXAMPLE 92 | A | A | A | A |

TABLE 4-continued

| | Charging element contamination | Image density | Transfer efficiency | Long-term stability |
|---|---|---|---|---|
| EXAMPLE 93 | B | A | A | B |
| EXAMPLE 94 | A | A | A | B |
| EXAMPLE 95 | A | B | A | A |
| EXAMPLE 96 | A | A | B | A |
| EXAMPLE 97 | A | A | A | B |
| EXAMPLE 98 | A | A | A | B |
| EXAMPLE 99 | A | A | A | A |
| EXAMPLE 100 | A | A | A | A |
| EXAMPLE 101 | A | A | B | A |
| EXAMPLE 102 | A | A | B | A |
| EXAMPLE 103 | A | B | A | A |
| EXAMPLE 104 | A | B | A | A |
| EXAMPLE 105 | A | A | A | A |
| EXAMPLE 106 | A | A | A | A |
| EXAMPLE 107 | A | A | A | A |
| EXAMPLE 108 | A | A | A | A |
| EXAMPLE 109 | A | A | A | A |
| EXAMPLE 110 | A | A | A | A |
| EXAMPLE 111 | A | A | A | A |
| EXAMPLE 112 | A | A | A | A |
| EXAMPLE 113 | A | A | A | B |
| EXAMPLE 114 | A | A | A | B |
| EXAMPLE 115 | A | A | A | B |
| EXAMPLE 116 | A | A | A | A |
| EXAMPLE 117 | A | A | B | A |
| EXAMPLE 118 | A | A | B | A |
| EXAMPLE 119 | A | B | B | A |
| EXAMPLE 120 | A | B | A | A |
| EXAMPLE 121 | B | A | B | B |

TABLE 5

| Comparative Example | Charging elements contamination | Image density | Transfer efficiency | Long-term stability |
|---|---|---|---|---|
| 1 | D | D | D | D |
| 2 | D | D | D | D |
| 3 | D | D | C | D |
| 4 | D | D | D | D |
| 5 | D | C | D | D |
| 6 | D | D | D | D |
| 7 | D | D | D | D |
| 10 | D | C | D | D |
| 11 | D | D | D | C |
| 12 | D | C | D | D |
| 13 | D | C | D | D |
| 14 | D | D | D | D |
| 15 | D | D | D | C |
| 16 | D | D | D | D |
| 17 | D | C | D | D |
| 18 | D | D | D | D |
| 19 | D | D | D | D |
| 20 | D | D | D | D |
| 21 | D | D | D | D |
| 22 | D | D | D | D |
| 23 | D | D | D | D |
| 24 | D | D | D | D |
| 25 | D | D | C | D |
| 26 | D | D | D | D |
| 27 | D | D | D | D |
| 28 | D | D | D | D |
| 29 | D | D | D | D |
| 30 | D | D | D | D |
| 31 | D | D | C | D |
| 32 | D | D | C | D |
| 33 | D | D | D | D |
| 34 | D | D | D | D |
| 35 | D | D | D | D |
| 36 | D | D | D | D |
| 37 | D | D | D | D |
| 38 | D | D | D | D |
| 39 | D | D | D | D |
| 40 | C | C | D | D |

TABLE 5-continued

| Comparative Example | Charging elements contamination | Image density | Transfer efficiency | Long-term stability |
|---|---|---|---|---|
| 41 | D | D | D | D |
| 42 | D | D | C | D |
| 43 | D | D | C | D |
| 44 | D | D | D | D |
| 45 | C | D | D | D |
| 46 | D | C | D | D |
| 47 | D | D | D | D |
| 48 | D | D | C | D |
| 49 | D | D | D | C |
| 50 | D | D | D | D |
| 51 | D | C | D | D |
| 52 | D | D | D | C |
| 53 | D | D | D | D |
| 54 | D | C | C | D |
| 55 | D | D | D | D |
| 56 | D | D | D | D |
| 57 | D | D | C | D |
| 58 | D | D | D | D |
| 59 | C | C | D | D |
| 60 | D | D | D | C |
| 61 | D | D | D | C |
| 62 | D | C | C | D |
| 63 | D | D | D | C |
| 64 | D | D | D | D |
| 65 | D | D | D | D |
| 66 | D | D | D | C |
| 67 | D | D | D | D |
| 68 | D | D | D | D |
| 69 | D | D | D | D |
| 70 | D | D | D | C |
| 71 | D | D | D | C |
| 72 | C | D | D | D |
| 73 | D | D | D | D |
| 74 | C | D | D | D |
| 75 | D | D | D | D |
| 76 | D | D | C | D |
| 77 | D | D | C | D |
| 78 | D | D | D | D |
| 79 | D | C | D | D |
| 80 | C | D | D | D |
| 81 | D | C | D | D |
| 82 | D | D | D | D |
| 83 | D | D | C | D |
| 84 | D | D | D | D |
| 85 | D | C | D | D |
| 86 | D | D | D | C |
| 87 | D | D | D | D |
| 88 | C | D | D | D |
| 89 | D | D | D | D |
| 90 | D | D | C | D |
| 91 | C | D | D | D |
| 92 | D | D | D | D |
| 93 | C | D | D | D |
| 94 | D | D | C | D |
| 95 | D | D | D | D |
| 96 | D | D | D | C |
| 97 | D | D | D | D |
| 98 | D | D | D | D |
| 99 | D | D | D | D |
| 100 | C | D | D | D |
| 101 | D | D | D | D |
| 102 | D | D | C | D |
| 103 | D | D | D | C |
| 104 | D | D | C | D |
| 105 | D | C | D | D |
| 106 | D | D | D | D |
| 107 | D | C | D | D |
| 108 | D | D | D | D |
| 109 | D | D | D | D |
| 110 | C | D | D | D |
| 111 | D | D | D | D |
| 112 | D | D | C | D |
| 113 | D | D | D | D |
| 114 | D | C | D | D |
| 115 | D | D | D | D |
| 116 | C | D | D | D |

TABLE 5-continued

| Comparative Example | Charging elements contamination | Image density | Transfer efficiency | Long-term stability |
|---|---|---|---|---|
| 117 | D | C | D | D |
| 118 | D | D | D | D |
| 119 | D | D | C | D |
| 120 | D | C | D | D |
| 121 | D | D | D | D |
| 122 | D | C | D | D |
| 123 | D | D | D | C |
| 124 | D | D | D | D |
| 125 | D | D | D | C |
| 126 | D | D | D | D |
| 127 | D | D | D | C |
| 128 | D | D | C | D |
| 129 | D | C | D | D |
| 130 | D | D | D | D |
| 131 | C | D | D | D |
| 132 | D | D | D | D |
| 133 | D | D | D | D |
| 134 | D | C | C | C |
| 135 | D | D | D | D |
| 136 | D | D | C | D |
| 137 | D | C | D | D |
| 138 | C | D | D | D |
| 139 | D | D | D | D |
| 140 | C | B | D | D |
| 141 | C | D | D | D |
| 142 | C | D | D | D |
| 143 | D | D | D | D |
| 144 | D | C | D | D |
| 145 | D | C | D | D |
| 146 | D | D | C | D |
| 147 | D | D | C | D |
| 148 | D | D | C | D |
| 149 | D | D | C | D |
| 150 | D | D | D | C |
| 151 | D | D | D | C |
| 152 | D | D | B | C |
| 153 | D | D | D | C |
| 154 | D | D | D | D |
| 155 | C | D | D | D |
| 156 | C | D | D | D |
| 157 | C | D | D | D |
| 158 | C | D | D | D |
| 159 | C | D | D | D |
| 160 | D | D | D | D |
| 161 | D | D | C | D |
| 162 | D | D | C | D |
| 163 | D | D | D | D |
| 164 | C | D | D | D |
| 165 | D | D | C | D |
| 166 | D | D | D | D |
| 167 | D | D | D | C |
| 168 | D | D | C | D |
| 169 | D | C | D | D |
| 170 | D | D | D | D |
| 171 | C | D | D | D |
| 172 | D | D | D | D |
| 173 | D | D | C | D |
| 174 | D | D | D | D |
| 175 | D | D | D | D |
| 176 | D | D | D | D |
| 177 | C | D | D | D |
| 178 | D | C | D | D |
| 179 | D | D | D | D |
| 180 | D | C | D | D |
| 181 | D | C | D | D |
| 182 | D | D | D | C |
| 183 | D | D | D | D |
| 184 | D | C | C | D |
| 185 | D | D | D | D |
| 186 | D | D | D | D |
| 187 | D | D | D | D |
| 188 | D | D | D | D |
| 189 | C | D | D | D |
| 190 | C | D | D | D |

TABLE 5-continued

| Comparative Example | Charging elements contamination | Image density | Transfer efficiency | Long-term stability |
|---|---|---|---|---|
| 191 | D | D | D | D |
| 192 | C | D | D | D |
| 193 | D | D | D | D |

As shown in Tables 4 and 5, the color toner of EXAMPLES 1 to 121 prepared by coating a composition comprising a fatty acid metal salt having average particle size of 0.05 to 3.0 μm, the first organic particle having average particle size of 0.3 to 2.0 μm, the second spherical organic particle having average particle size of 0.05 to 0.25 μm, and silica had an advantage in terms of contamination of charging element, image density, transfer efficiency and long term stability compared to the color toner of Comparative Examples 1-193. It is confirmed that fatty acid metal salt provides a reduction in contamination of the surface of OPC and PCR by improving the cleaning property of the OPC drum, and that the organic particle having different average particle size is coated on the toner mother particle to reduce the adhesion of the toner mother particle, leading to sphere-like behavior of the toner particle.

As described above, the non-magnetic mono-component color toner of the present invention is advantageous in terms of contamination of the charging elements, narrow charge distribution, high chargeability, superior image quality and transfer efficiency, long-term stability, and thus long-term reliability.

What is claimed is:

1. A non-magnetic mono-component color toner comprising a toner mother particle, and a coating layer formed on the toner mother particle, wherein the coating layer comprises a fatty acid metal salt having average particle size of 0.05 to 3.0 μm, a first organic particle having average particle size of 0.3 to 2.0 μm, a second organic particle having average particle size of 0.05 to 0.25 μm, and silica having average particle size of 0.006 to 0.04 μm.

2. The non-magnetic mono-component color toner according to claim 1, wherein the color toner has average particle size of 3.0 μm to 20 μm, and aspect ratio of short radius against long radius of 0.3 to 0.8.

3. The non-magnetic mono-component color toner according to claim 1, wherein the thickness of the coating layer is 30 nm to 2.0 μm.

4. The non-magnetic mono-component color toner according to claim 1, wherein the fatty acid metal salt has average particle size of 0.5 to 1.5 μm.

5. The non-magnetic mono-component color toner according to claim 1, wherein the fatty acid metal salt is a salt prepared by a fatty acid with 4 to 20 carbon atoms, and a metal selected from the group consisting of Na, K, Al, Ca, Zn, Mg, Co, Fe, Mn, Ba, Vd and Sn.

6. The non-magnetic mono-component color toner according to claim 5, wherein the fatty acid is at least one selected from the group consisting of caproic acid, caprylic acid, capric acid, lauric acid, myristric acid, millistrike oleic acid, palmitic acid, palmitoleic acid, stearic acid, oleic acid, linoleic acid, linolenic acid, arachidic acid, arachidonic acid, beheic acid, elchaic acid, montenic acid, iso-stearic acid, and epoxy stearic acid.

7. The non-magnetic mono-component color toner according to claim 5, wherein the fatty acid metal salt includes metal in the amount of 2.0 to 10 wt %.

8. The non-magnetic mono-component color toner according to claim 5, wherein the fatty acid metal salt is contained in the amount of 0.1 to 2.0 parts by weight with respect to the toner mother particle of 100 parts by weight.

9. The non-magnetic mono-component color toner according to claim 1, wherein the first organic particle has average particle size of 0.4 to 2.0 μm.

10. The non-magnetic mono-component color toner according to claim 1, wherein the second organic particle has average particle size of 0.1 to 0.15 μm.

11. The non-magnetic mono-component color toner according to claim 1, wherein the first organic particle and the second organic particle are the same material or of different materials.

12. The non-magnetic mono-component color toner according to claim 1, wherein the first organic particle and the second organic particle are (a) a homopolymer or a copolymer prepared by one or more monomer selected from the group consisting of: styrenes such as styrene, methyl styrene, dimethyl styrene, ethyl styrene, phenyl styrene, chloro styrene, hexyl styrene, octyl styrene, and nonyl styrene; vinylhalides such as vinylchloride and vinylfluoride; vinylesters such as vinylacetate and vinylbenzoate; methacrylates such as methylmethacrylate, ethyl methacrylate, propyl methacrylate, n-butyl methacrylate, iso-butyl methacrylate, 2-ethyihexyl methacrylate, and phenyl methacrylate; acrylic acid derivatives such as acrylonitrile, and methacrylonitrile; acrylates such as methylacrylate, ethylacrylate, butylacrylate, and phenylacrylate; tetrafluoroethylene; and 1,1-difluoroethylene; or (b) a mixture of a polymer selected from the group consisting of the homopolymer and the copolymer, and a resin selected from the group consisting of stryrene-based resin, epoxy-based resin, polyester-based resin, and polyurethane-based resin.

13. The non-magnetic mono-component color toner according to claim 1, wherein the first organic particle and the second organic particle are respectively contained in the amount of 0.1 to 1.5 parts by weight with respect to toner mother particle of 100 parts by weight.

14. The non-magnetic mono-component color toner according to claim 1, wherein the silica has average particle size of 0.01 to 0.02 μm.

15. The non-magnetic mono-component color toner according to claim 1, wherein the silica is plain silica, or modified silica which is prepared by treatment of the surface with a modifying agent selected from the group consisting of dimethyldichlorosilane, dimethylpolysiloxane, hexamethyldisilazane, aminosilane, alkylsilane of C1 to C20, and octamethylcyclotetrasiloxane.

16. The non-magnetic mono-component color toner according to claim 1, wherein the toner mother particle further comprises a binder resin and colorant.

17. The non-magnetic mono-component color toner according to claim 16, wherein the binder resin is at least one selected from the group consisting of polystyrene-based resin, polyester-based resin, polyethylene resin, polypropylene resin, styrene-alkylacrylate copolymer of C1 to C18, styrene-alkylmethacrylate copolymer, styrene-acrylronitrile copolymer, stryrene-butadiene copolymer, and styrene-malerate copolymer.

18. The non-magnetic mono-component color toner according to claim 16, wherein the colorant is one selected from the group consisting of cyan, magenta, yellow and black pigments and dyes.

19. A method of preparation of non-magnetic mono-component color toner comprising the steps of:

putting a toner mother particle into a mixer, and mixing by addition of a fatty acid metal salt having average particle size of 0.05 to 3.0 μm, a first organic particle having average particle size of 0.3 to 2.0 μm, a second organic particle having average particle size of 0.05 to 0.25 μm, and silica having average particle size of 0.006 to 0.04 μm to form the coating layer on the toner mother particle.

20. The method of preparation of non-magnetic mono-component color toner according to claim 19, wherein the color toner comprises the toner mother particle of 100 parts by weight, the fatty acid metal salt of 0.1 to 2.0 parts by weight, the first organic particle of 0.1 to 1.5 parts by weight, the second organic particle of 0.1 to 1.5 parts by weight, and the silica of 1.0 to 4.0 parts by weight.

21. The method of preparation of non-magnetic mono-component color toner according to claim 19, wherein the mixer is selected from the group consisting of HENSCHEL mixer, a turbin type stirrer, a super mixer, and hybridizer.

22. The method of preparation of non-magnetic mono-component color toner according to claim 19, wherein the mixing step is performed at tip speed of 10 to 30 m/sec.

* * * * *